US008806783B2

(12) United States Patent
Chase et al.

(10) Patent No.: US 8,806,783 B2
(45) Date of Patent: Aug. 19, 2014

(54) ARTICLES ADAPTED TO RELEASABLY RECEIVE INTERCHANGEABLE ORNAMENTS AND SYSTEM THEREFOR

(75) Inventors: Kathe Chase, New York, NY (US); Tracy Kramer Seckler, Great Barrington, MA (US); Thomas Perreault, Dalton, MA (US)

(73) Assignee: Luxyco, LLC, Great Barrington, MA (US)

( * ) Notice: Subject to any disclaimer, the term of this patent is extended or adjusted under 35 U.S.C. 154(b) by 0 days.

(21) Appl. No.: 13/424,171

(22) Filed: Mar. 19, 2012

(65) Prior Publication Data

US 2012/0234042 A1 Sep. 20, 2012

Related U.S. Application Data

(63) Continuation of application No. 13/198,542, filed on Aug. 4, 2011, now abandoned, which is a continuation-in-part of application No. 12/504,229, filed on Jul. 16, 2009, now abandoned.

(60) Provisional application No. 61/081,105, filed on Jul. 16, 2008, provisional application No. 61/147,622, filed on Jan. 27, 2009.

(51) Int. Cl.
*A43B 23/24* (2006.01)

(52) U.S. Cl.
USPC ..... 36/136; 36/11.5

(58) Field of Classification Search
USPC ..... 36/136, 11.5, 134; 2/245; 24/109, 590.1
See application file for complete search history.

(56) References Cited

U.S. PATENT DOCUMENTS

| | | | | |
|---|---|---|---|---|
| 2,928,191 | A | | 3/1960 | Meltzer |
| 3,011,281 | A | | 5/1961 | King |
| 3,141,211 | A | | 7/1964 | Blake |
| 3,336,683 | A | | 8/1967 | Schellkopf |
| 3,978,596 | A | | 9/1976 | Brown et al. |
| 3,999,311 | A | | 12/1976 | Epstein |
| 4,698,923 | A | * | 10/1987 | Arff ..... 36/128 |
| 4,712,319 | A | | 12/1987 | Goria |

(Continued)

OTHER PUBLICATIONS

International Search Report for International Application No. PCT/US2009/50854 dated Sep. 1, 2009.

(Continued)

*Primary Examiner* — Ted Kavanaugh
(74) *Attorney, Agent, or Firm* — Lisa M. Treannie, Esq.; Morse, Barnes-Brown & Pendleton, P.C.

(57) ABSTRACT

A sandal can include a sole, one or more straps each having at least one end that is operationally connected to the sole, and a fastening member for releasably receiving an ornament comprising one or more protruding members. The fastening member can be coupled to at least one of the one or more straps and can include an inner cavity and a housing at least partially enclosing the inner cavity. An opening can be disposed in and through an upper portion of the housing in such a way that the opening leads to the inner cavity. One or more projections can be joined with the housing and can extend into the inner cavity. Each of the one or more projection can be situated at a position along a path of motion of at least one of the one or more protruding member from an unfastened position to a fastened position.

15 Claims, 21 Drawing Sheets

(56) References Cited

U.S. PATENT DOCUMENTS

| | | | | |
|---|---|---|---|---|
| 4,864,736 | A | 9/1989 | Bierk | |
| 5,052,131 | A | 10/1991 | Rondini | |
| 5,456,095 | A * | 10/1995 | Tawil et al. | 63/29.1 |
| 5,673,501 | A | 10/1997 | Mathews | |
| 6,216,279 | B1 | 4/2001 | Ellingson | |
| 6,412,151 | B1 | 7/2002 | Rowland | |
| 6,442,869 | B2 | 9/2002 | Coomes | |
| 6,463,681 | B1 * | 10/2002 | Savoie | 36/134 |
| 6,651,359 | B1 | 11/2003 | Bricker | |
| 6,769,204 | B1 | 8/2004 | Phillips | |
| 6,904,706 | B2 | 6/2005 | Jones et al. | |
| 7,155,782 | B2 | 1/2007 | Napurano | |
| 7,200,959 | B2 | 4/2007 | Spann | |
| 7,318,260 | B2 | 1/2008 | Pearce | |
| 7,418,793 | B2 | 9/2008 | Dominguez et al. | |
| 7,481,008 | B2 | 1/2009 | Lusk | |
| 7,600,334 | B2 | 10/2009 | Cox et al. | |
| 7,650,704 | B2 | 1/2010 | Richardson | |
| 7,698,836 | B2 | 4/2010 | Schmelzer et al. | |
| 7,735,243 | B1 | 6/2010 | Gilkey et al. | |
| 8,069,538 | B2 * | 12/2011 | Wilcox | 24/109 |
| 2002/0112372 | A1 * | 8/2002 | Coomes | 36/11.5 |
| 2002/0121030 | A1 | 9/2002 | Coleman | |
| 2004/0078997 | A1 | 4/2004 | Pledger | |
| 2004/0093765 | A1 | 5/2004 | Baldwin | |
| 2005/0274039 | A1 | 12/2005 | Lee | |
| 2006/0007668 | A1 | 1/2006 | Chien | |
| 2006/0048408 | A1 | 3/2006 | Spann | |
| 2006/0053663 | A1 | 3/2006 | Mao | |
| 2006/0107550 | A1 | 5/2006 | Caminiti | |
| 2007/0256325 | A1 | 11/2007 | Berdych | |
| 2008/0060110 | A1 | 3/2008 | Schmelzer et al. | |
| 2010/0011623 | A1 | 1/2010 | Seckler et al. | |

OTHER PUBLICATIONS

Non-Final Office Action for U.S. Appl. No. 12/504,229 (listed on SB-08 as US 2010-0011623), mailed Jan. 18, 2012.

* cited by examiner

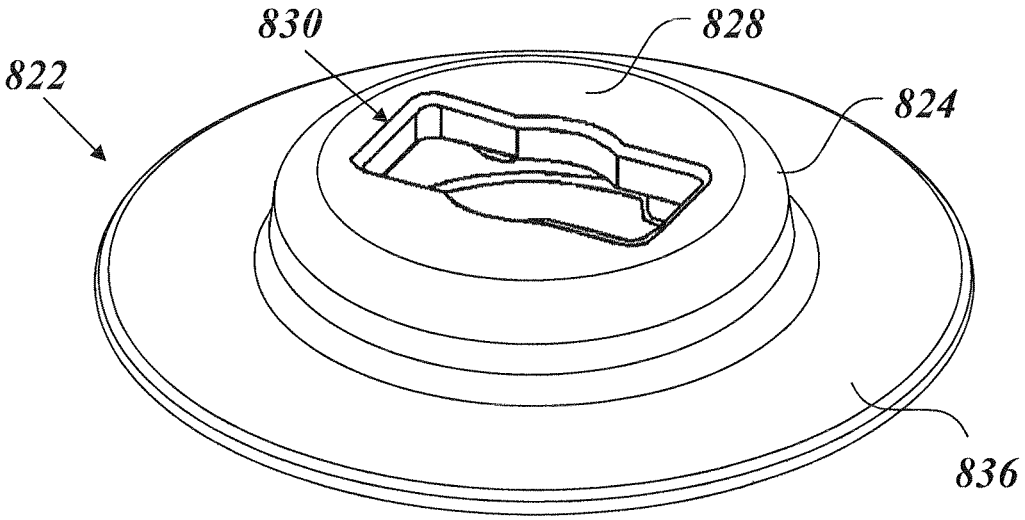
FIG. 9A (perspective view)
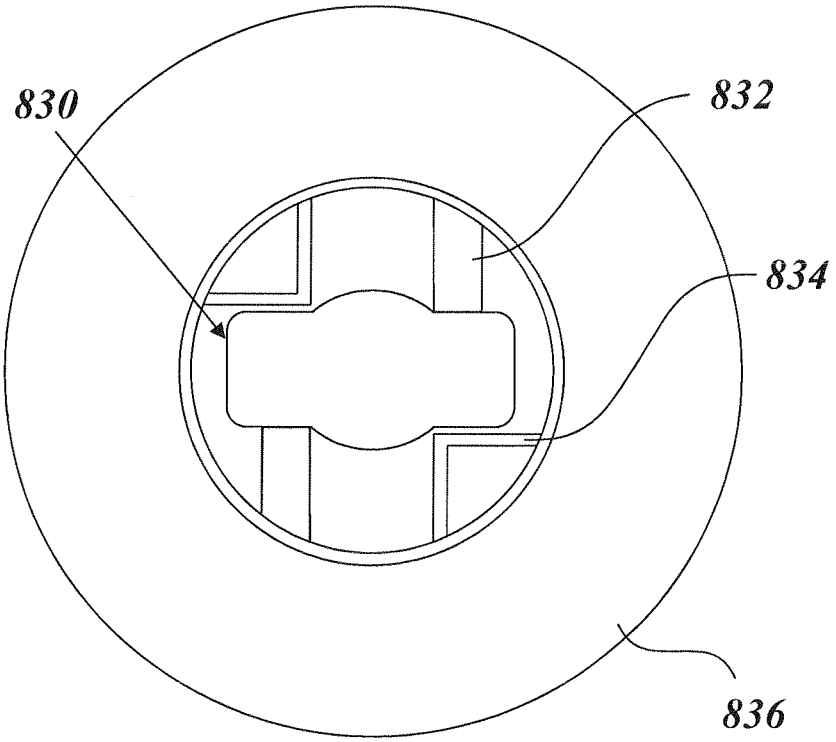
FIG. 9B (bottom view)

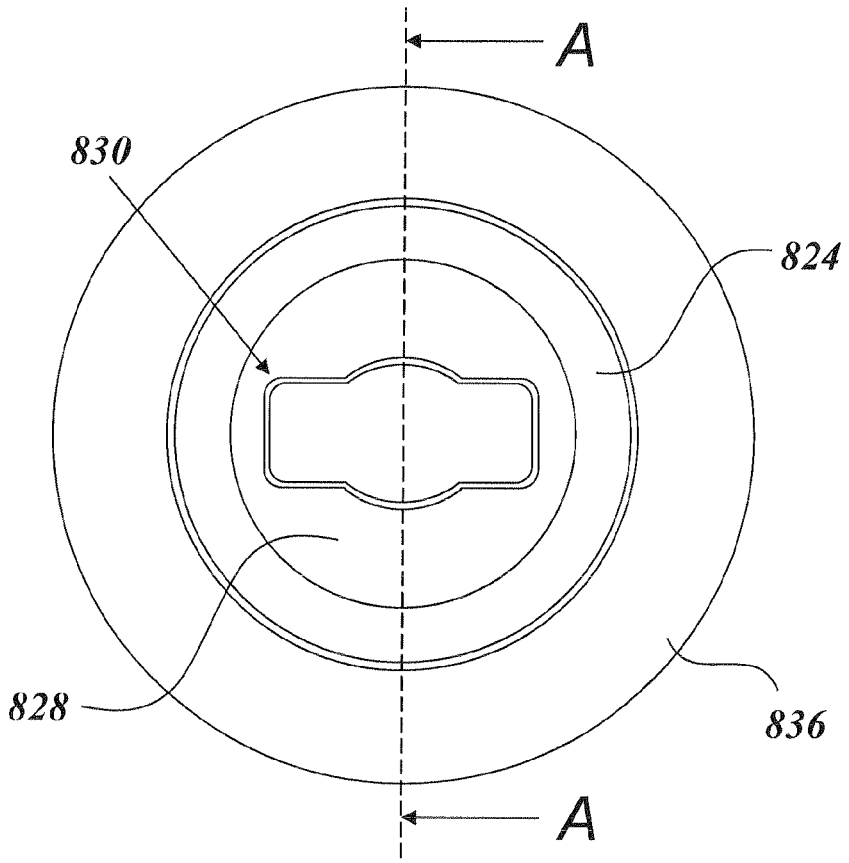
FIG. 9C (top view)
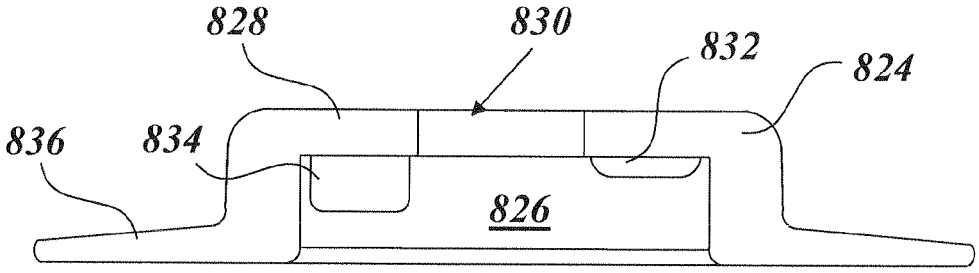
FIG. 9D (View along A-A)

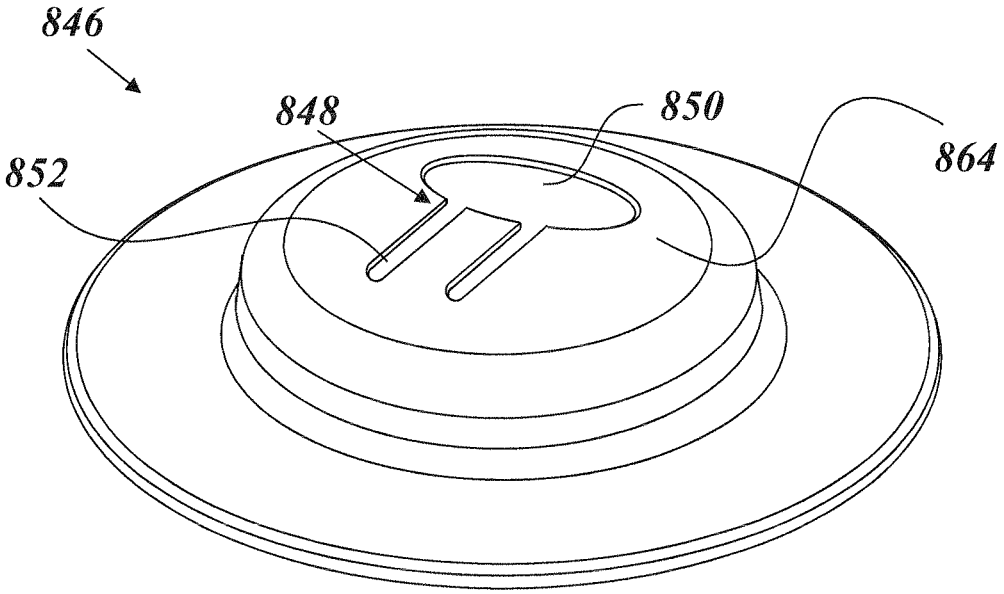
FIG. 12A (perspective view)
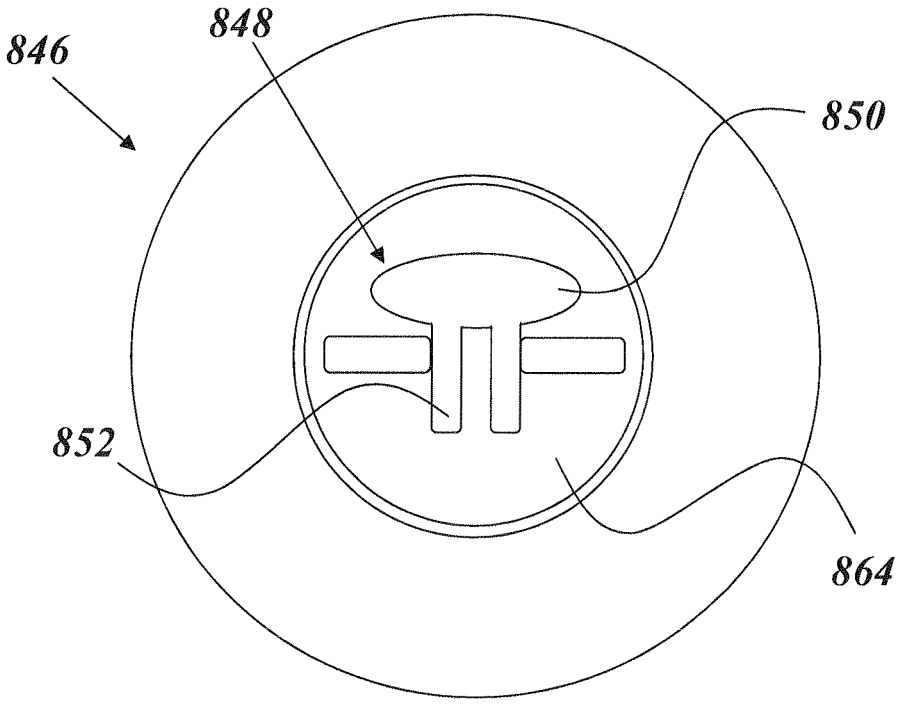
FIG. 12B (bottom view)

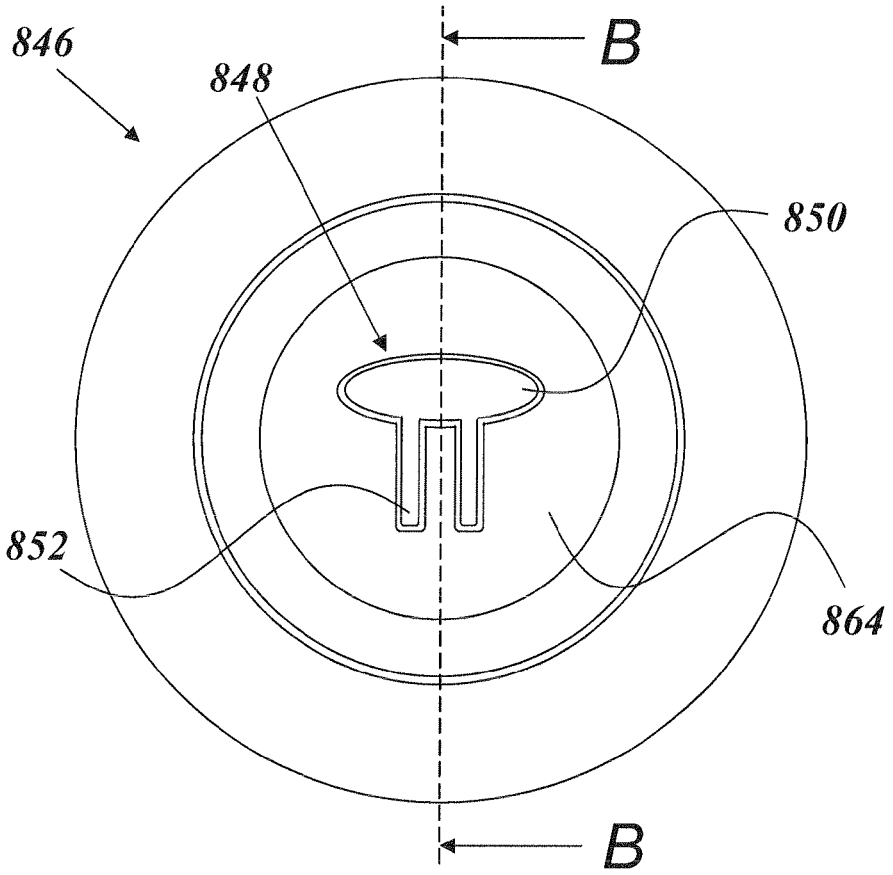
FIG. 12C (top view)
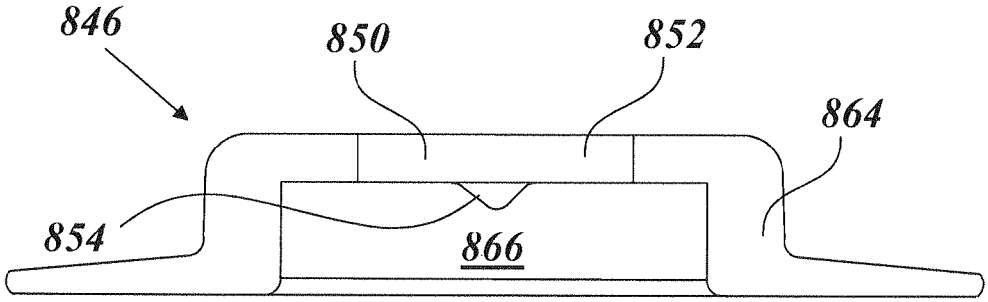
FIG. 12D (view along B-B)

ARTICLES ADAPTED TO RELEASABLY RECEIVE INTERCHANGEABLE ORNAMENTS AND SYSTEM THEREFOR

RELATED APPLICATIONS

This application is Continuation of U.S. patent application Ser. No. 13/198,542, filed Aug. 4, 2011, which is a Continuation-in-Part of U.S. patent application Ser. No. 12/504,229, filed Jul. 16, 2009, which claims the benefit of Provisional Application No. 61/081,105 filed Jul. 16, 2008, and Provisional Application No. 61/147,622 filed Jan. 27, 2009, the teachings of each of which are herein incorporated by reference in their entirety.

TECHNICAL FIELD

The present application discloses footwear, such as a sandal or flip-flop, and other articles having an attachment mechanism that is useful in attaching replaceable and interchangeable ornaments such as charms or other decorative ornaments or attachments.

BACKGROUND

Flip-flop type sandals are becoming increasingly popular. A variety of styles of these sandals are being worn, and ornaments are occasionally attached to the sandals as permanent decorations. However, durability, ease-of-use, and compatibility with a wider range of materials are limiting factors for systems for interchangeably attaching decorative ornaments to existing flip-flop sandals and other articles.

SUMMARY

Accordingly, there remains a need in the art for a flip-flop sandal and other articles comprising a receiver fastening member that enables convenient replacement of interchangeable ornaments. The receiver fastening members, flip-flop sandals, and other articles described herein provide further solutions to address these and other needs, in addition to having other benefits that will be appreciated by one of skill in the art upon reading the present specification.

In one disclosed embodiment, a sandal can include a sole, one or more straps positioned to maintain the sandal on the foot of the wearer, each of the one or more straps having at least one end that is operationally connected to the sole, and a fastening member for releasably receiving an ornament comprising one or more protruding members. The fastening member can be coupled to at least one of the one or more straps and can include an inner cavity and a housing at least partially enclosing the inner cavity. An opening can be disposed in and through an upper portion of the housing in such a way that the opening leads to the inner cavity. The opening can have one or more portions that are shaped to receive the one or more protruding members of the ornament. One or more projections can be joined with the housing and can extend into the inner cavity. Each of the one or more projections can be situated at a position along a path of motion of at least one of the one or more protruding member from an unfastened position to a fastened position.

In another disclosed embodiment, a kit can include at least one of an ornament and at least one of a sandal. The ornament can include one or more protruding members and the sandal can include a sole, one or more straps positioned to maintain the sandal on the foot of the wearer, each of the one or more straps having at least one end that is operationally connected to the sole, and a fastening member for releasably receiving the ornament. The fastening member can be coupled to at least one of the one or more straps. The fastening member can include an inner cavity and a housing at least partially enclosing the inner cavity. An opening can be disposed in and through an upper portion of the housing in such a way that the opening leads to the inner cavity. The opening can have one or more portions that are shaped to receive the one or more protruding members of the ornament. One or more projections can be joined with the housing and can extend into the inner cavity. Each of the one or more projection can be situated at a position along a path of motion of one of the one or more protruding member from an unfastened position to a fastened position.

In yet another disclosed embodiment, an article can include a fastening member for releasably receiving an ornament comprising one or more protruding members. The fastening member can include an inner cavity and a housing at least partially enclosing the inner cavity. An opening can be disposed in and through an upper portion of the housing in such a way that the opening leads to the inner cavity. The opening can have one or more portions that are shaped to receive the one or more protruding members of the ornament. One or more projections can be joined with the housing and can extend into the inner cavity, and each of the one or more projection can be situated at a position along a path of motion of one of the one or more protruding member from an unfastened position to a fastened position.

As additional aspects of the disclosed embodiments, the one or more projections can have a flexibility sufficient to deform in response to a force exerted by the protruding member of the ornament. The one or more projections can be joined with the housing on an inner face of the housing, e.g., on the upper portion of the housing, on a lower or bottom portion of the housing, or on a sidewall of the housing. The fastening member further can include one or more stopping members extending into the cavity and joined with the housing. The housing can comprise a base portion, which can comprise a tapered flange. The fastening member further can include one or more spaces for releasably securing the one or more protruding members in a fastened position. The path of motion of the one or more protruding members can comprise, for example, about a 90° arc. At least one of the one or more projections can include a first sloped portion and a second sloped portion that slopes in an opposite direction longitudinally from the first sloped portion. The first sloped portion can have a first slope and the second sloped portion can have a second slope that is the same or different from the magnitude of the first slope. At least one of the one or more projections can include a first sloped portion and a second portion that is perpendicular to an inner face of the upper portion of the housing. The fastening member can comprise, for example, nylon, nylon/glass composite, nylon/talc composite, or polypropylene.

In embodiments adapted for an article, the fastening member can be coupled to a portion of the article in an operationally permanent manner, and the fastening member can be coupled to a portion of the article that may comprise leather. For embodiments wherein one or more straps are included, the fastening member can be coupled to at least one of the one or more straps in an operationally permanent manner, and at least one of the one or more straps can comprise leather.

In yet another disclosed embodiment, a flip-flop sandal can include a sole, at least one of a strap coupled to the sole and positioned to maintain the sandal on the foot of a wearer, and a fastening member coupled to the strap for releasably receiving an ornament that comprises a protruding member. The fastening member can include an inner cavity and a housing at least partially enclosing the inner cavity. An opening can be disposed in and through an upper surface of the housing in such a way that the opening leads to the inner cavity. The opening can be shaped to receive the protruding member of the ornament. A flexible projection can extend into the inner cavity and can being joined with an inner face of the upper surface of the housing on a first side of the opening. The flexible projection can have a flexibility sufficient to deform in response to a force caused by rotation of the protruding member of the ornament within the inner cavity. A first stopping member can extend into the inner cavity and be joined with the inner face of the upper surface of the housing on the first second side of the opening. A second stopping member can extend into the inner cavity and be joined with the inner face of the upper surface of the housing on a second side of the opening that is opposite the first side of the opening. The flexible projection and the first stopping member can form a space for securely and releasably maintaining the protruding member of the ornament in a fastened position.

BRIEF DESCRIPTION OF THE DRAWINGS

These and other characteristics of the present invention will be more fully understood by reference to the following detailed description in conjunction with the attached drawings, in which:

FIGS. 9A, 9B, 9C, and 9D illustrate in greater detail the example receiver fastening member of FIG. 8B including one or more projections disposed in a path of motion of a protruding member on an ornament to be fastened to the sandal;

FIGS. 12A, 12B, 12C, and 12D illustrate an alternative embodiment of a receiver fastening member utilizing linear motion to move a protruding member of an ornament into a fastened position;

DETAILED DESCRIPTION

Figure 1A:
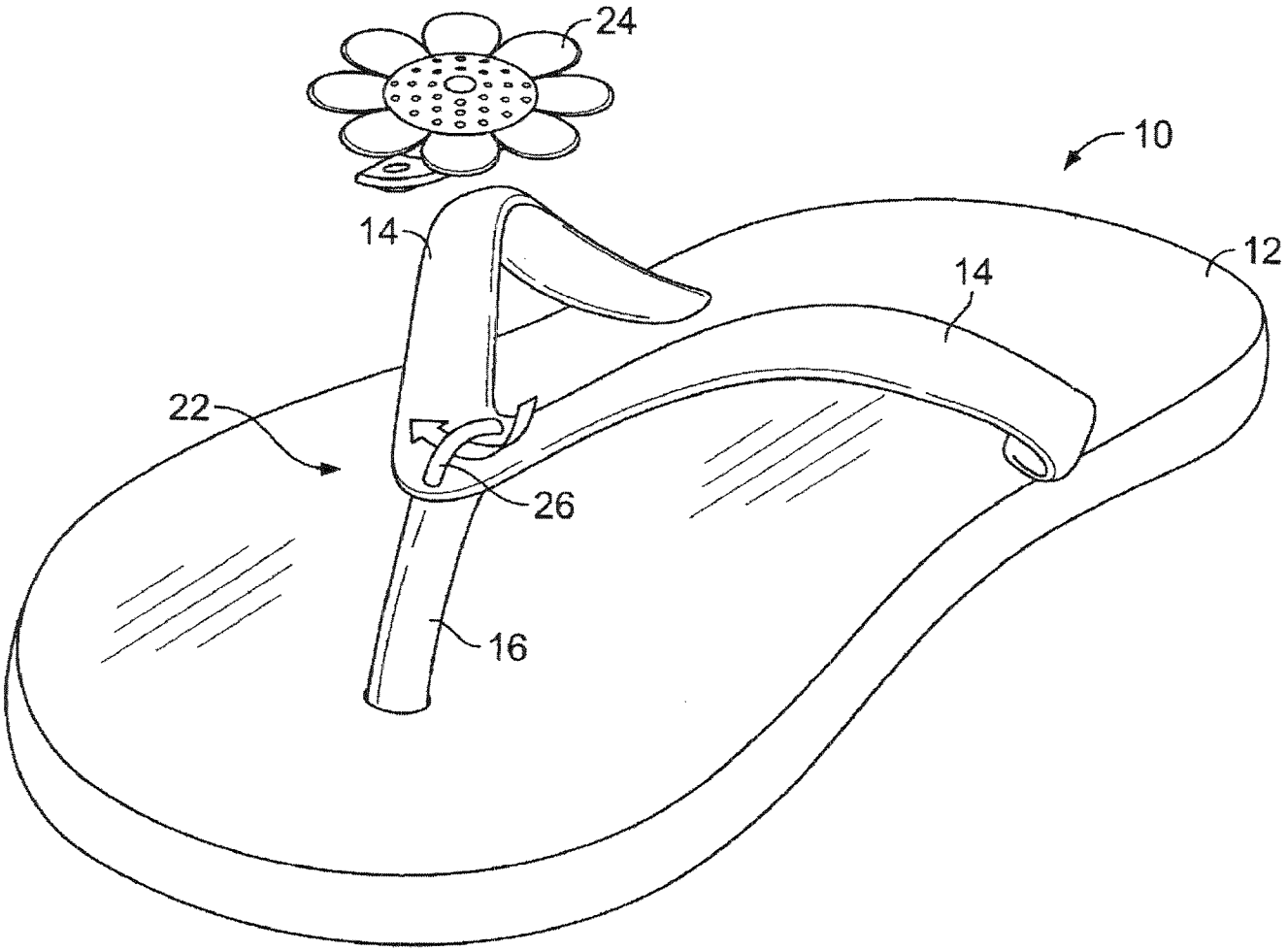
FIGS. 1A, 1B, and 1C illustrate a clip and loop that are usable to fasten an ornament to a flip flop sandal.

According to the detailed description below, a fastening system is employed to fasten an ornament to a flip-flop or other article. The fastening system includes first and second fastening members. In some embodiments, at least a substantial portion of the first fastening member is embedded in the thong of the flip-flop. In other embodiments, at least a portion of the first fastening member is embedded in or securely attached to one or more of the strap(s). The second fastening member is suitably attached to or formed integral with an ornament. The first fastening member may be a male member, and the second fastening member may be a female member. Alternatively, the first fastening member may be a female member, and the second fastening member may be a male member. As a further alternative, the first and second fastening members may be neutral members. Other alternatives are possible. The first fastening member may be referred to as a receiver fastening member because it receives the second fastening member whether the second fastening member is a male member, a female member, a neutral member, or otherwise. The fastening system permits the ornament to be removably fastened to the flip-flop or article.

It should be noted that flip-flops are presented as specific implementations of the fastening system described herein, the fastening system can be used in connection with other articles, including articles of apparel such as pocket books/purses, shoes, belts, clothing, and other articles of apparel that are "worn" by people.

As described herein, in some embodiments, at least a portion or substantial portion of the first fastening member (the receiver fastening member) is embedded in the apparel in order to receive the second fastening member of the ornament. In such embodiments, because the receiver fastening member is integrated into the apparel such as the flip-flop, the receiver fastening member is more secure, more stable, and more permanent than fastening mechanisms which are currently in use to attach an ornament to a shoe. The receiver fastening member can be hidden and protected by the shoe, sheltering the receiver fastening member from surface tension, surface contacts, and other outside elements that could weaken the receiver fastening member, or diminish the longevity of adherence of the receiver fastening member. Furthermore, the risk that the foot's normal rocking motion will eventually destabilize a fastening member that is affixed to the top of a shoe and not at least substantially embedded in the shoe is substantially reduced. The receiver fastening member described herein can be specifically designed for frequent ornament switching, making it simple to both push in and pull out the ornament, while keeping the ornament securely fastened when it is in place. Fastening members are known which make it easy either to attach an ornament or to remove an ornament, but no known fastening member does both, and no known fastening member is integrated into the shoe, making it completely durable and sturdy. In other embodiments the fastening member is securely fastened, e.g., by way of stiching, to the article (e.g., flip-flop); this embodiment may be particularly useful in instances where the article is made of leather.

FIGS. 1 through 14C, wherein like parts are designated by like reference numerals throughout, illustrate example embodiments of a flip-flop having a fastening member embedded at least partially therein. Although example embodiments are illustrated in the figures and described throughout, it should be understood that many alternative forms, modifications, and embodiments are possible. One of skill in the art will additionally appreciate different ways to alter the parameters of the embodiments disclosed, such as the size, shape, or type of elements or materials.

Figure 1B:
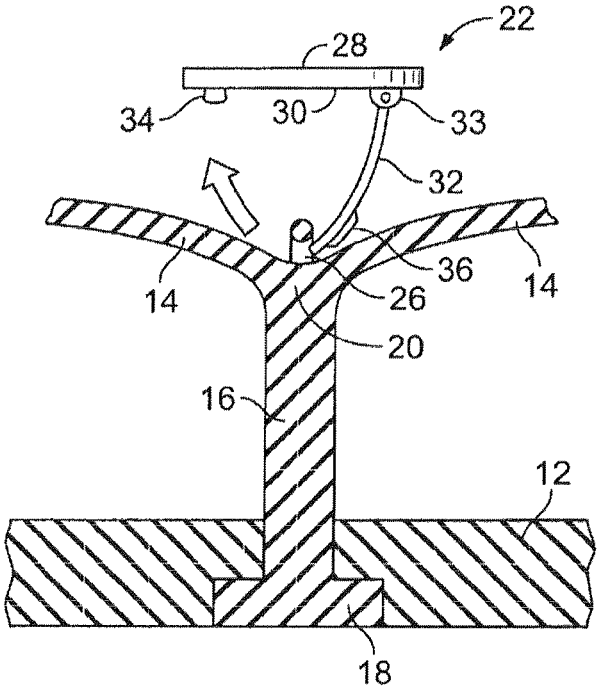
Figure 1C:
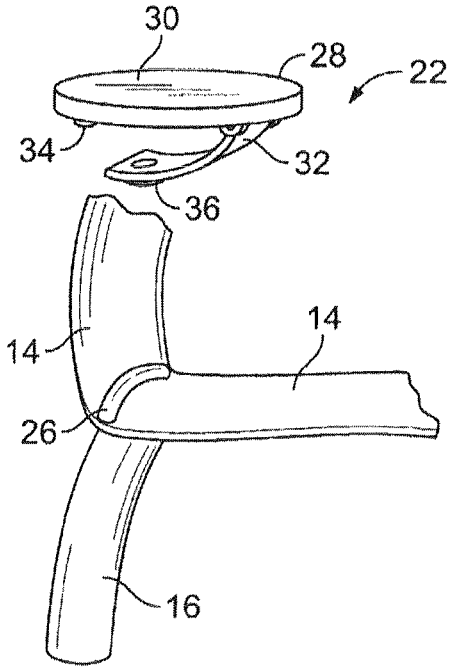

FIGS. 1A, 1B, and 1C show a flip-flop sandal 10 that has a sole 12 and straps 14 formed as is common in flip-flop sandals. First ends of the straps 14 are suitably attached to the sole 12. A thong 16 extends from the sole 12 to second ends of the straps 14 and is positioned so that it fits between the first and second toes of the wearer. The thong 16 has a post base 18 embedded in the sole 12 and a top portion 20 that engages the straps 14. The straps 14 and the thong 16 may be integrally formed or the straps 14 may be suitably attached and fixed to the thong 16.

A fastening system 22 is provided to fasten a replaceable and interchangeable ornament 24 to the flip-flop sandal 10. The fastening system 22 includes a loop 26 (a female fastening member) and a clip 28 (a male fastening member). The loop 26 has both of its ends embedded such as by molding into the thong 16 of the flip-flop sandal 10 so that at least a substantial portion of the loop 26 is embedded into the thong 16. The clip 28 includes a clip base 30 that is in the form of a disk or any other shape and that is suitable for receiving and retaining the replaceable and interchangeable ornament 24. The replaceable and interchangeable ornament 24 may be fixedly fastened to the clip base 30 in any desired manner such as by soldering, gluing, or welding. Alternatively, the replaceable and interchangeable ornament 24 may be fastened to the clip base 30 in any suitable releasable manner. The clip 28 further includes a hook 32 attached to the clip base 30 by a hinge 33. The clip base 30 includes a tine 34 and the hook 32 includes a tine receiver 36. The tine receiver 36 may include a recess just large enough to receive the tine 34 in a friction fit.

The second ends of the straps 14 joined to the top portion 20 may be separate ends suitably attached to one another and they may be integrally formed together. Similarly, the top portion 20 may be suitably attached to the second ends of the straps 14 or may be integrally formed with the second ends of the straps 14.

During fastening of the replaceable and interchangeable ornament 24 to the flip-flop sandal 10, the hook 32 is inserted through the loop 26 and the clip is secured to the flip-flop sandal 10 by pressing the tine 34 in the tine receiver 36. According, the tine receiver 36 holds fast to the tine 34 by a friction fit and the replaceable and interchangeable ornament 24 is thereby replaceably and interchangeably fastened to the flip-flop sandal 10.

If the replaceable and interchangeable ornament 24 is to then be replaced by another replaceable and interchangeable ornament, the tine 34 is unfastened from the tine receiver 36, and the hook 32 is pulled back through the loop 26 to remove the replaceable and interchangeable ornament 24 from the flip-flop sandal 10. The other ornament can then be replaceably and interchangeably secured to the flip-flop sandal 10 in the same manner as the replaceable and interchangeable ornament 24 was replaceably and interchangeably secured to the flip-flop sandal 10 (i.e., in the manner described in the immediately preceding paragraph).

Figure 2A:
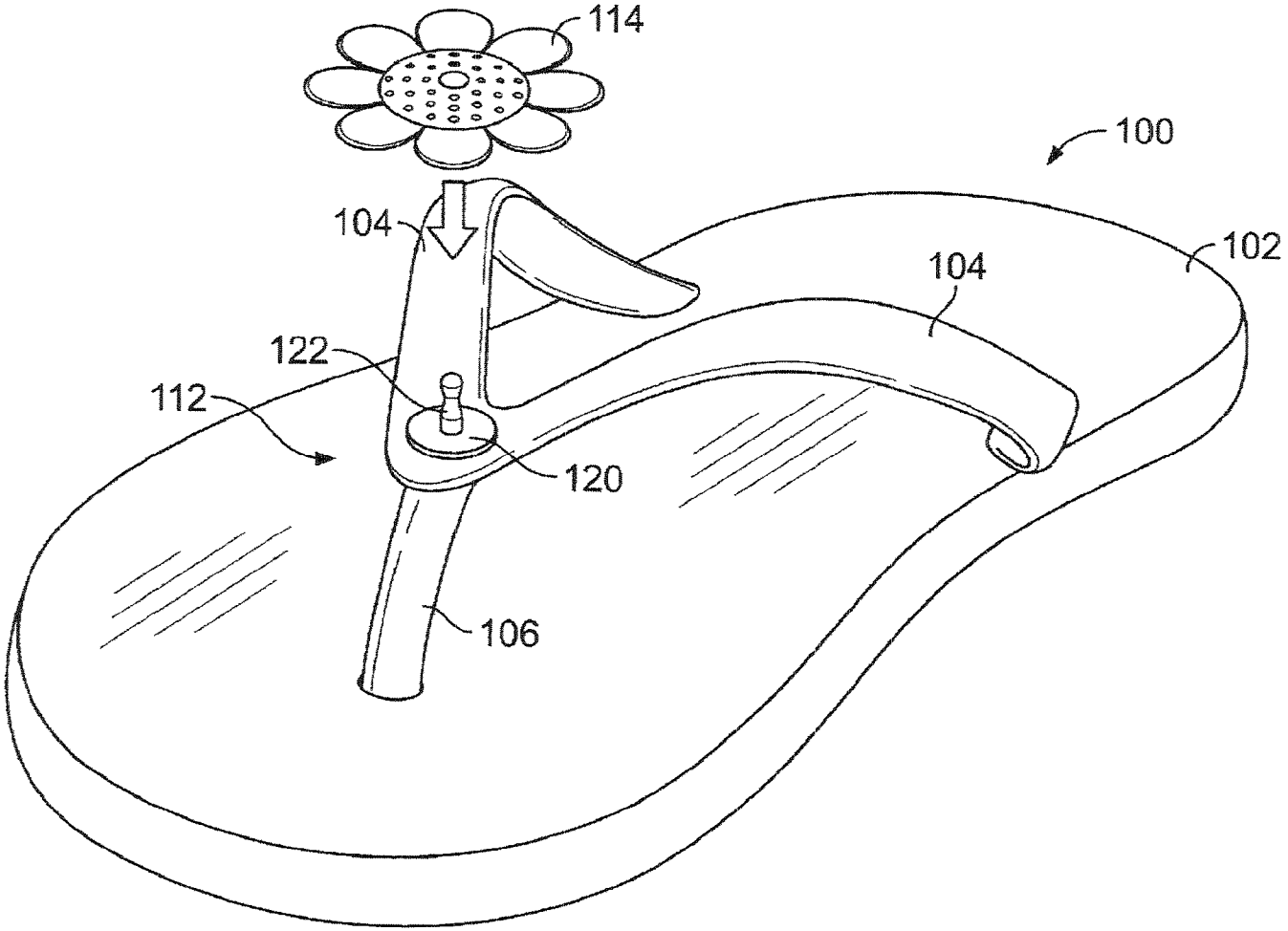
FIGS. 2A, 2B, and 2C illustrate a snap that is usable to fasten an ornament to a flip flop sandal.
Figure 2B:
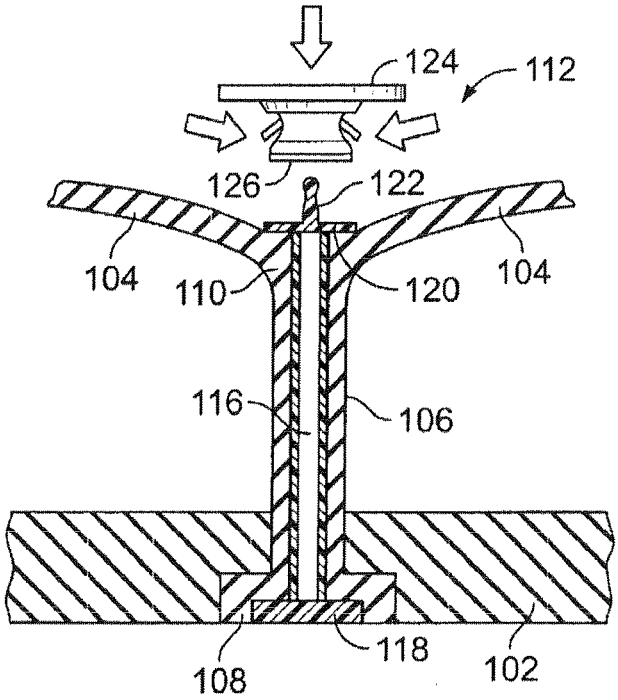
Figure 2C:
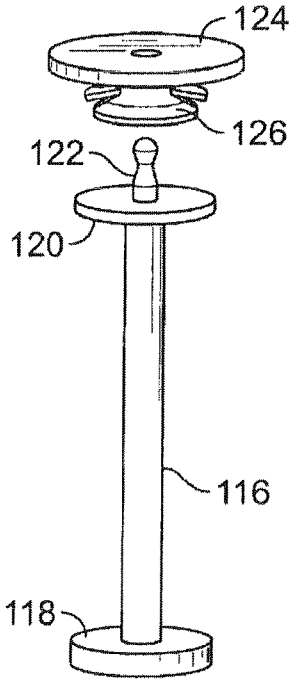

FIGS. 2A, 2B, and 2C show a flip-flop sandal 100 that has a sole 102 and straps 104 formed as is common in flip-flop sandals. A thong 106 extends from the sole 102 to the straps 104 and is positioned so that it fits between the first and second toes of the wearer. The thong 106 has a post base 108 embedded in the sole 102 and a top portion 110 that suitably engages the straps 104.

A fastening system 112 is provided to fasten a replaceable and interchangeable ornament 114 to the flip-flop sandal 100. The fastening system 112 has a male fastening member that includes a rod 116 extending through and embedded into the thong 106, a first rod disk 118 at one end anchored in the post base 108, and a second rod disk 120 at the other end attached to a snap post 122 (a male fastening member). Thus, at least a substantial portion of this male fastening member is embedded into the thong 106. The second rod disk 120 sits on top of the thong 106. The fastening system 112 further includes a snap base 124 (a female fastening member) that has a disk shape and that is suitable for receiving and retaining the replaceable and interchangeable ornament 114. The replaceable and interchangeable ornament 114 may be suitably fastened to the snap base 124. For example, the replaceable ornament 124 may be fixedly or releaseably fastened to the snap base 124 in any desired manner. The snap base 124 further includes a snap post receiver 126. The snap post receiver 126 may include a recess just large enough to receive the snap post 122.

The second ends of the straps 104 joined to the top portion 110 may be separate ends suitably attached to one another and they may be integrally formed together. Similarly, the top portion 110 may be suitably attached to the second ends of the straps 104 or may be integrally formed with the second ends of the straps 104.

During fastening of the replaceable and interchangeable ornament 114 to the flip-flop sandal 100, the snap post 122 is pressed into the snap post receiver 126. According, the snap post receiver 126 holds fast to the snap post 122 by a friction fit as is typical for snaps, and the replaceable and interchangeable ornament 114 is thereby fastened to the flip-flop sandal 100.

If the replaceable and interchangeable ornament 114 is to then be replaced by another replaceable and interchangeable ornament, the replaceable and interchangeable ornament 114 is pulled so that the friction fit between the snap post 122 and the snap post receiver 126 is overcome and the replaceable and interchangeable ornament 114 is withdrawn from the flip-flop sandal 100. The other ornament can then be replaceably and interchangeably secured to the flip-flop sandal 100 in the same manner as the replaceable and interchangeable ornament 114 was replaceably and interchangeably secured to the flip-flop sandal 100 (i.e., in the manner described in the immediately preceding paragraph).

Figure 3A:
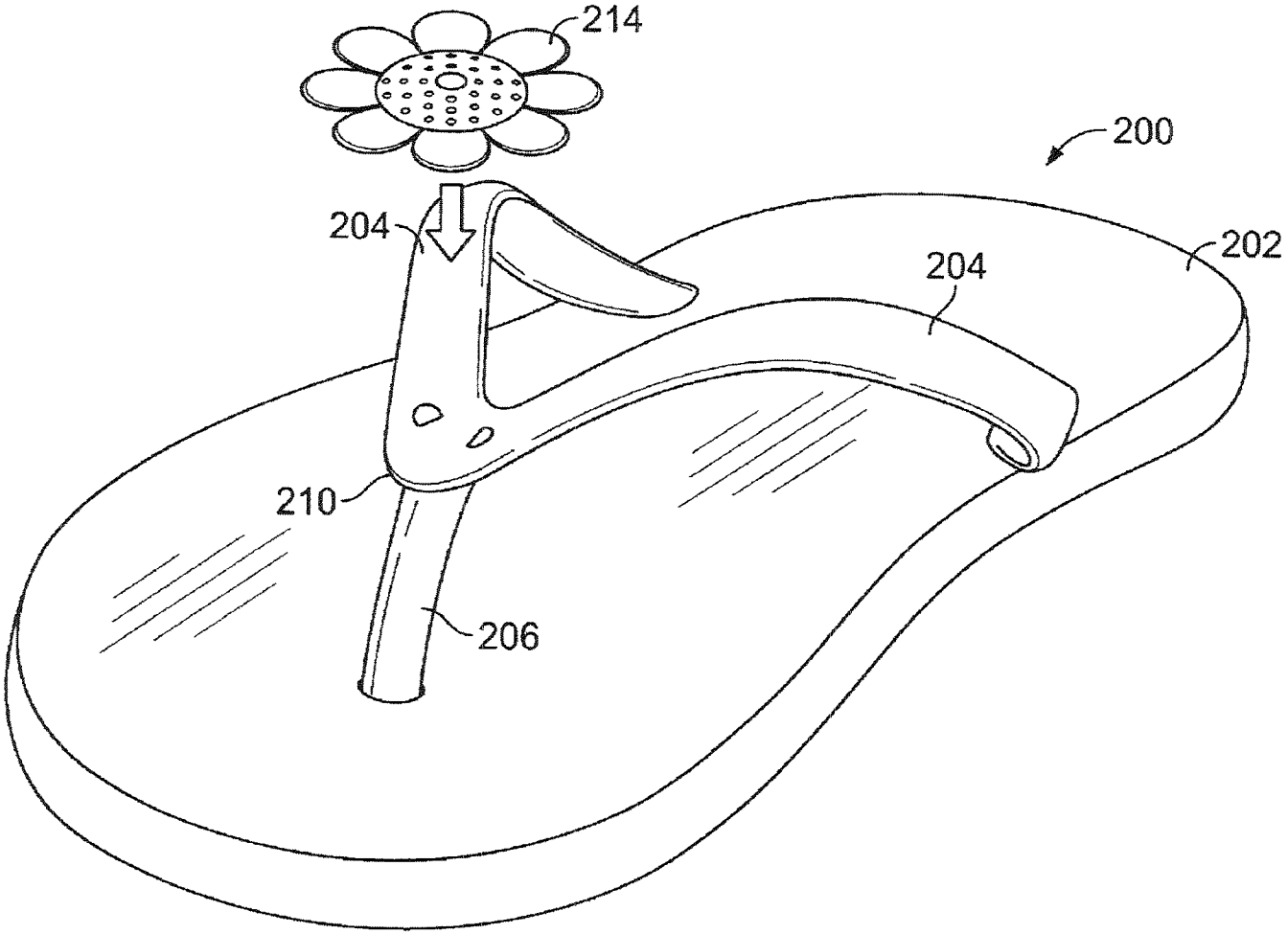
FIGS. 3A, 3B, and 3C illustrate a prong that is usable to fasten an ornament to a flip flop sandal.
Figure 3B:
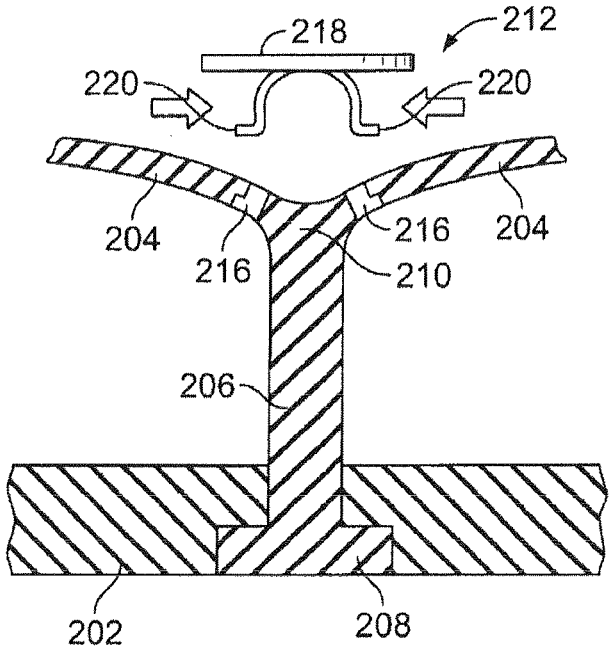
Figure 3C:
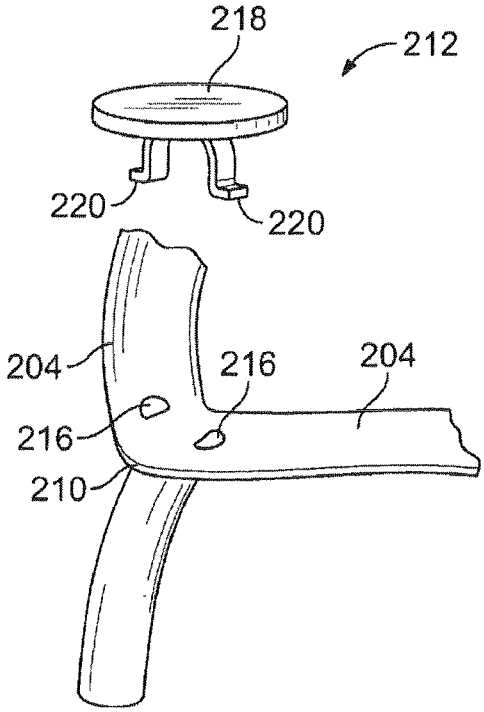

FIGS. 3A, 3B, and 3C show a flip-flop sandal 200 that has a sole 202 and straps 204 formed as is common in flip-flop sandals. A thong 206 extends from the sole 202 to the straps 204 and is positioned so that it fits between the first and second toes of the wearer. The thong 206 has a post base 208 embedded in the sole 202 and a top portion 210 that suitably engages the straps 204.

A fastening system 212 is provided to fasten a replaceable and interchangeable ornament 214 to the flip-flop sandal 200. The fastening system 212 includes prong receiving holes 216 (female fastening members) molded into and embedded within the thong 206. Thus, at least a substantial portion of this female fastening member is embedded into the thong 206. The fastening system 212 further includes a prong base 218 that has a disk shape and that is suitable for fixedly or releaseably receiving and retaining the replaceable and interchangeable ornament 214. The replaceable and interchangeable ornament 214 may be fastened to the prong base 218 in any desired manner. The prong base 218 further includes prongs 220 (male fastening members).

The second ends of the straps 204 joined to the top portion 210 may be separate ends suitably attached to one another and they may be integrally formed together. Similarly, the top portion 210 may be suitably attached to the second ends of the straps 204 or may be integrally formed with the second ends of the straps 204.

During fastening of the replaceable and interchangeable ornament 214 to the flip-flop sandal 200, the prongs 220 are pressed into and through the prong receiving holes 216. According, the prongs 220 hold fast to the straps 204 by a friction fit. Alternatively, the ends of the prongs 220 may have tabs that lock to the underside of the straps 204 when the prongs 220 are pressed into and through the prong receiving holes 216.

If the replaceable and interchangeable ornament 214 is to then be replaced by another replaceable and interchangeable ornament, the replaceable and interchangeable ornament 214 is pulled so that the friction fit between the prongs 220 and the prong receiving holes 216 is overcome and the replaceable and interchangeable ornament 214 can be withdrawn from the flip-flop sandal 200. Alternatively, the prongs 220 are pinched toward each other until the tabs clear the underside of the straps 204, and the replaceable and interchangeable ornament 214 is withdrawn from the flip-flop sandal 200. The other ornament can then be replaceably and interchangeably secured to the flip-flop sandal 200 in the same manner as the replaceable and interchangeable ornament 214 was replaceably and interchangeably secured to the flip-flop sandal 200 (i.e., in the manner described in the immediately preceding paragraph).

Figure 4A:
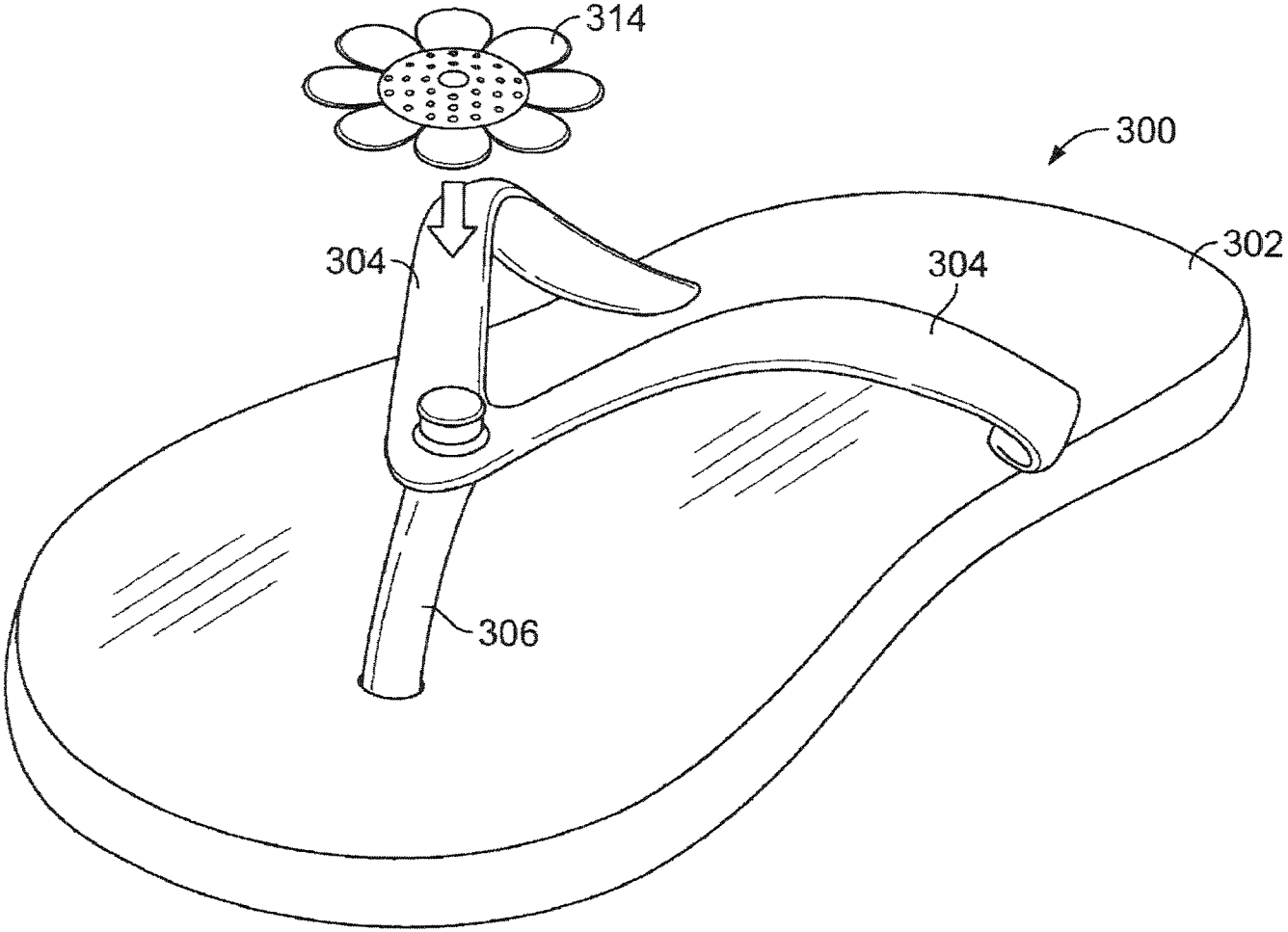
FIGS. 4A, 4B, and 4C illustrate another snap that is usable to fasten an ornament to a flip flop sandal.
Figure 4B:
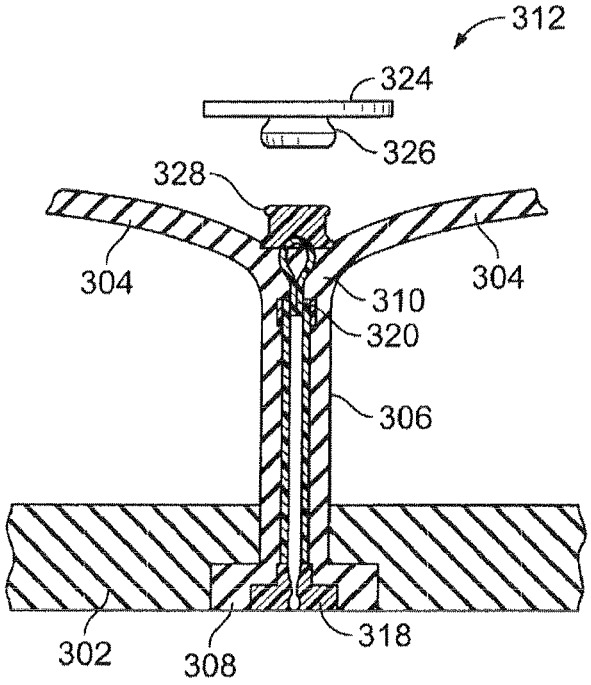
Figure 4C:
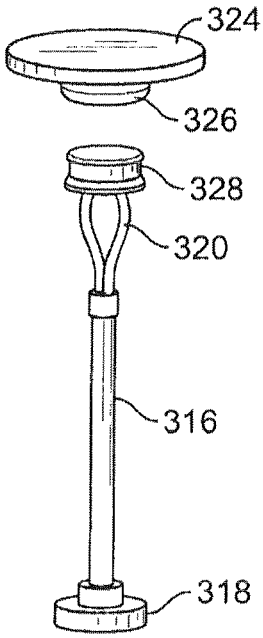

FIGS. 4A, 4B, and 4C show a flip-flop sandal 300 that has a sole 302 and straps 304 formed as is common in flip-flop sandals. A thong 306 extends from the sole 302 to the straps 304 and is positioned so that it fits between the first and second toes of the wearer. The thong 306 has a post base 308 embedded in the sole 302 and a top portion 310 that suitably engages the straps 304.

A fastening system 312 is provided to fasten a replaceable and interchangeable ornament 314 to the flip-flop sandal 300. The fastening system 312 includes an elastic member 316 (which may instead be a rod or another mechanism that functions in a similar manner to the elastic member). The elastic member 316 extends through and is embedded in the thong 106 and has an anchor 318 at one end anchored in the post base 308 and a snap button support 320 (a male fastening member) at the other end. The elastic anchor 318 could be a rod or some other mechanism. Thus, at least a substantial portion of this male fastening member is embedded into the thong 306. The fastening system 312 includes a snap base 324 that has a disk shape and that is suitable for receiving and retaining the replaceable and interchangeable ornament 314. The replaceable and interchangeable ornament 314 may be fixedly or releaseably fastened to the snap base 324 in any desired manner. The snap base 324 includes a snap button receiver 326 (a female fastening member). The snap button receiver 326 may include a recess just large enough to receive a snap button 328 (a male fastening member) securely supported by the snap button support 320. The snap button 328 is embedded in the thong 306. The fastening system 312 could instead be a snap-like assembly.

The fastening system 312 includes, but need not include, an elastic to give the assembly flexibility and/or give when the wearer is detaching the ornament from the fastener. The elastic may be replaced with some other mechanism that functions in the same manner as the elastic.

The second ends of the straps 304 joined to the top portion 310 may be separate ends suitably attached to one another and they may be integrally formed together. Similarly, the top portion 310 may be suitably attached to the second ends of the straps 304 or may be integrally formed with the second ends of the straps 304.

During fastening of the replaceable ornament 314 to the flip-flop sandal 300, the snap button 328 is pressed into the snap button receiver 326. According, the snap button receiver 326 holds fast to the snap button 328 by a friction fit as is typical for snaps, and the replaceable and interchangeable ornament 314 is thereby fastened to the flip-flop sandal 300.

If the replaceable and interchangeable ornament 314 is to then be replaced by another replaceable and interchangeable ornament, the replaceable and interchangeable ornament 314 is pulled so that the friction fit between the snap button receiver 326 and the snap button 328 is overcome and the replaceable and interchangeable ornament 314 can be withdrawn from the flip-flop sandal 300. The other ornament can then be replaceably and interchangeably secured to the flip-flop sandal 300 in the same manner as the replaceable and interchangeable ornament 314 was replaceably and interchangeably secured to the flip-flop sandal 300 (i.e., in the manner described in the immediately preceding paragraph).

The replaceable and interchangeable ornament is attached by a two part fastener, one of the fastening parts being embedded in the thong. The fastener may be any of the fastening system 22, the fastening system 112, the fastening system 212, the fastening system 312, the fastening system 412, and/or any other fastening system that has one piece embedded in the thong and the other piece attached to the ornament. Additionally, the fastener may be a magnet assembly.

Figure 5A:
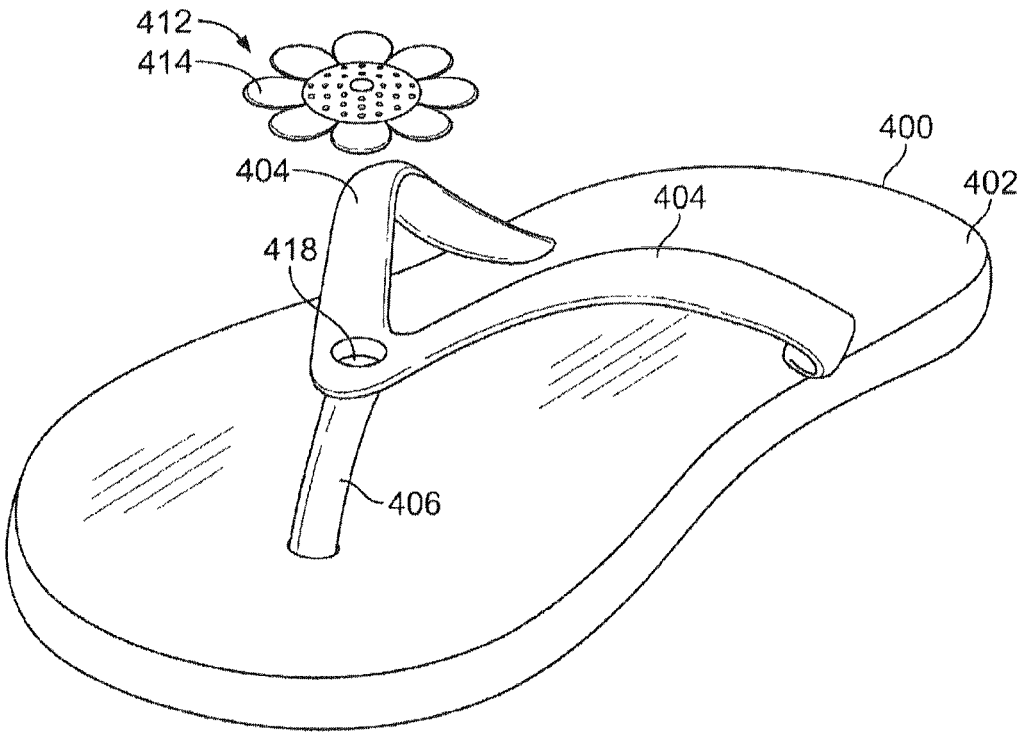
FIGS. 5A and 5B illustrate a magnet based arrangement that is usable to fasten an ornament to a flip flop sandal.
Figure 5B:
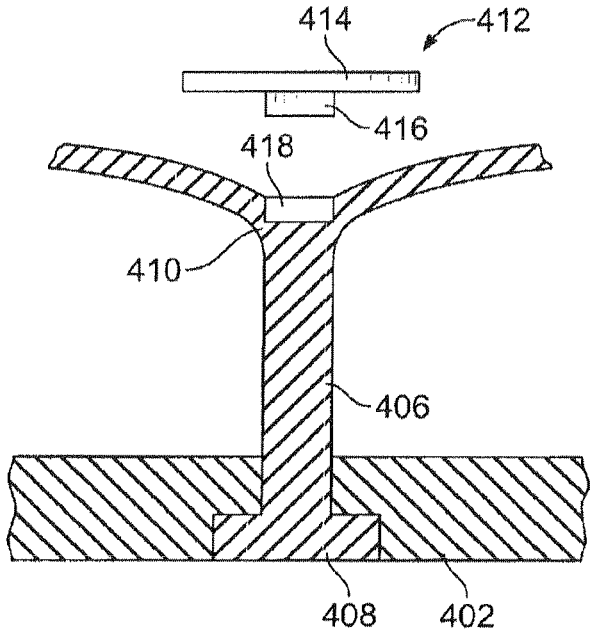

Accordingly, FIGS. 5A and 5B show a flip-flop sandal 400 that has a sole 402 and straps 404 formed as is common in flip-flop sandals. A thong 406 extends from the sole 402 to the straps 404 and is positioned so that it fits between the first and second toes of the wearer. The thong 406 has a base 408 embedded in the sole 402 and a top portion 410 that suitably engages the straps 404.

A fastening system 412 is provided to fasten a replaceable and interchangeable ornament 414 to the flip-flop sandal 400. The fastening system 412 includes first and second magnets 416 and 418. The first magnet 416 is suitably fastened to the replaceable and interchangeable ornament 414, and the second magnet 418 is embedded such as by molding into the thong 406 of the flip-flop sandal 400. Thus, at least a substantial portion of the second magnet 418 is embedded into the thong 406. The first and second magnets 416 and 418 (one of which may be considered to be a male fastening member and the other of which may be considered to be a female fastening member) have opposite magnetic polarities. Accordingly, the replaceable and interchangeable ornament 414 may be magnetically, releaseably, and interchangeably fastened to the thong 406.

The second ends of the straps 404 joined to the top portion 410 may be separate ends suitably attached to one another and they may be integrally formed together. Similarly, the top portion 410 may be suitably attached to the second ends of the straps 404 or may be integrally formed with the second ends of the straps 404.

Alternatively, the fastener may use a shaft and notch.

Figure 6A:
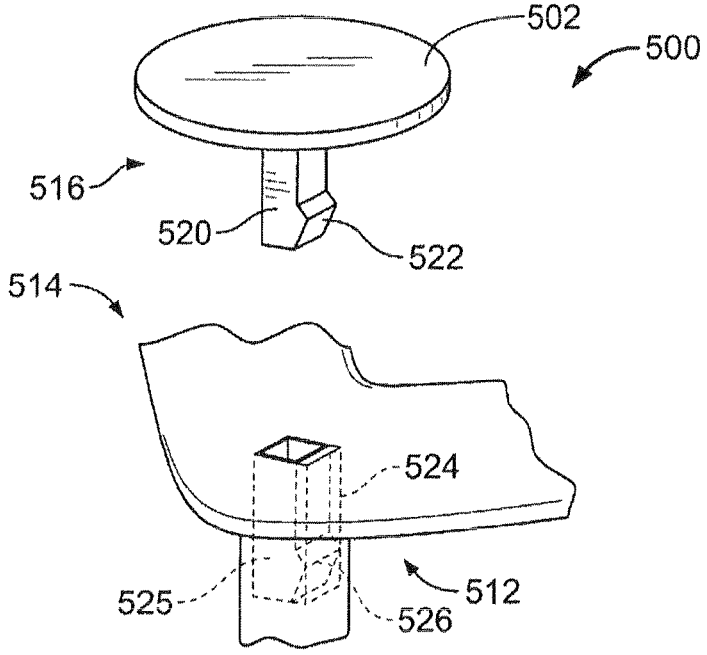
FIGS. 6A and 6B illustrate a shaft and notch arrangement that is usable to fasten an ornament to a flip flop sandal.
Figure 6B:
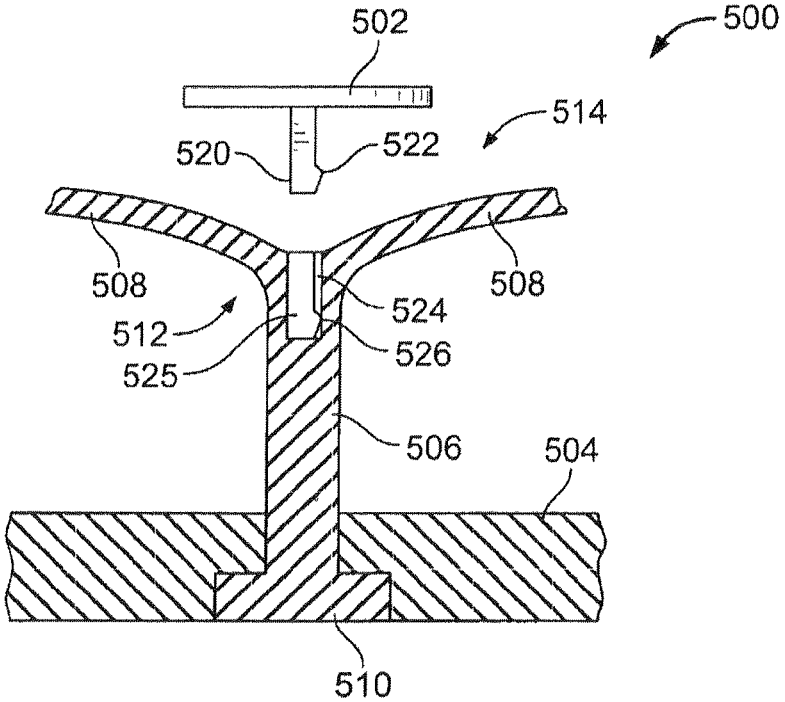

Accordingly, FIGS. 6A and 6B show an ornament attachment arrangement 500 for attaching a replaceable and interchangeable ornament 502 to a flip-flop sandal. A thong 506 extends from a sole 504 to straps 508 of a flip-flop sandal and is positioned so that it fits between the first and second toes of the wearer. The thong 506 has a base 510 embedded in the sole 504 and a top portion 512 that suitably engages the straps 508.

A fastening assembly 514 is provided to fasten the replaceable and interchangeable ornament 502 to the flip-flop sandal. The fastening assembly 514 includes an insert 516 (a male fastening member) and a receiver 518 (a female fastening member). A substantial portion of this female fastening member is embedded into the thong 506. The insert 516 includes a post 520 that has a prong 522 at an end thereof. The prong 522, for example, has a tooth like edge. The receiver 518 includes a hole 524 and a receiver insert 525 that is within the hole 524 and that has a shape matching the shape of the insert 516. Thus, the receiver insert 525 has a notch 526 that accommodates the prong 522. The receiver insert 525 may have barbs around its exterior arranged to dig into the thong 506 so as to securely retain the receiver insert 525 in the hole 524. The post 520 and the receiver insert 525 may be plastic or any other suitable material.

The post 520 and/or the top portion 512 of the thong 506 is flexible enough to permit the post 520 to slide through the hole 524 so that the prong 522 passes through the top portion 512 until the prong 522 becomes nested in the notch 526 and rigid enough so that, once the prong 522 is nested in the notch 526, the friction between the post 520 and the top portion 512 resists accidental dislodgement of the replaceable ornament 502 from the thong 506. Accordingly, the replaceable and interchangeable ornament 502 is releaseably and interchangeably fastened to the thong 506.

The second ends of the straps 508 joined to the top portion 512 may be separate ends suitably attached to one another and they may be integrally formed together. Similarly, the top portion 512 may be suitably attached to the second ends of the straps 508 or may be integrally formed with the second ends of the straps 508.

The prong 522 and the notch 526 may have other shapes, and the prong 522 and the notch 526 may have any desired length or numbers. For example, the post 520 may have the prong 522 as a first prong on one side and a second prong on another side, such as the opposite side, of the post 520. In this example, the hole 524 has the notch 526 as a first notch on one side and a second notch on another side, such as the opposite side) of the hole 524. Accordingly, when the releasable and interchangeable ornament is to be releaseably attached to the sandal, the post 520 is inserted into the hole 524 so that the first prong passes through the top portion 512 until it becomes nested in the first notch and so that the second prong passes through the top portion 512 until it becomes nested in the second notch.

As another example, the post 520 may have four prongs 522 distributed therearound, and the hole 524 may have four corresponding notches 526.

As still another example, the one or more prongs 522 may be replaced by a single ring shaped catch extending around the post 520, and the one or more notches 526 may be replaced by a single continuous notch extending around the hole 524.

Also, the ornament attachment arrangement 500 may be combined with the magnet arrangement shown in FIGS. 5A and 5B. In such a case, the post 520 and the hole 524 may be provided with magnets of opposite polarity to assist in releaseably fastening the replaceable and interchangeable ornament 502 to the thong 506. For example, a first magnet may be provided at the end of post 520 farthest from the replaceable ornament 502 and a second magnet may be placed at the bottom of the hole 524.

As still further alternatives, the fastener may use a screw, a hook and loop, a clip, or any combination of these or other mechanisms, or any other releasable mechanism, to attach the ornament to the sandal.

Figure 8A:
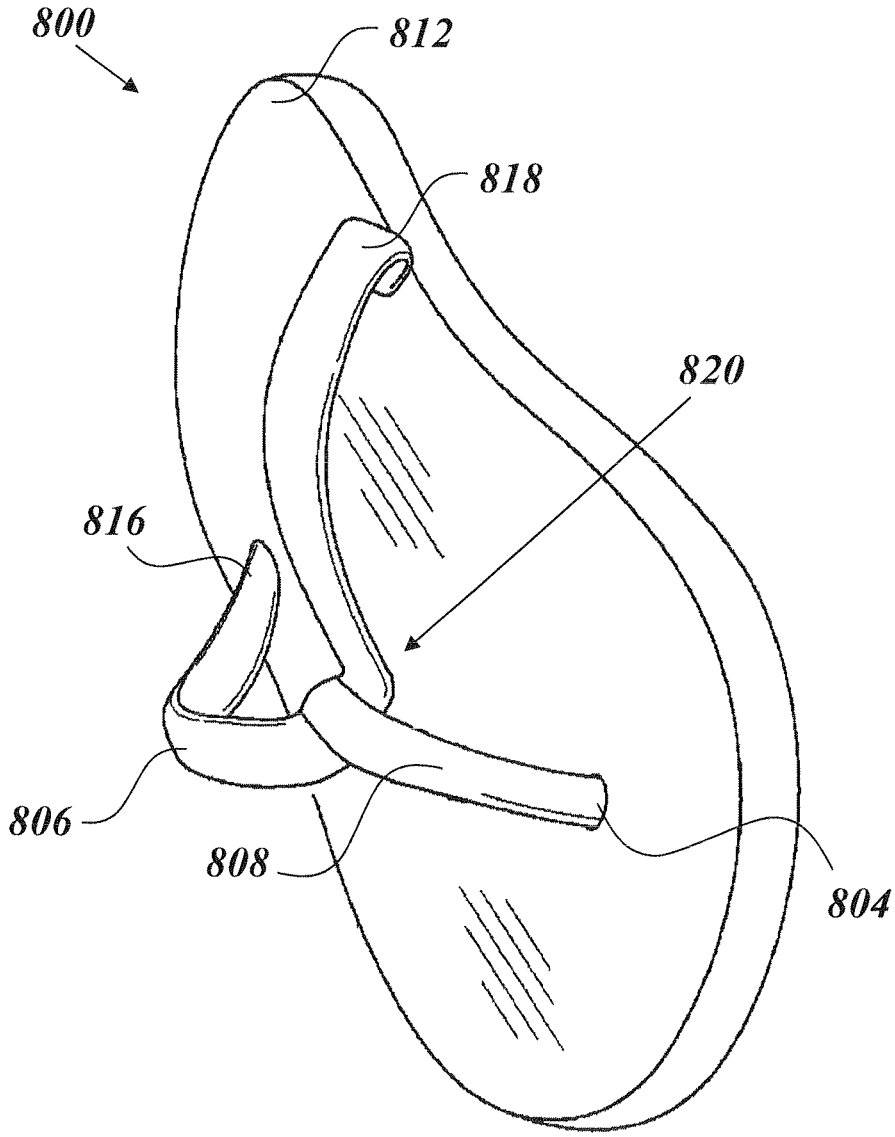
FIGS. 8A and 8B illustrate a sandal having one or more straps forming a junction at which an example receiver fastening member can be coupled.

FIG. 8A depicts an additional embodiment a flip-flop sandal 800 that has a sole 812 and one or more straps positioned to maintain the sandal 800 on the foot of a wearer. For example, the sandal 800 can include a first strap 806 having two ends 816 and 818 and a second strap 808. The two ends 816 and 818 of the first strap 806 can be suitably attached (e.g., non-removably) to the sole 812, for example each at a position substantially near the middle, the back, or the front of the sandal 800. The two ends 816 and 818 of the first strap 806 lead to a junction 820 whereat the first strap 806 and the second strap 808 are fixedly joined together. For example, the second strap 808 can form a U like shape both ends of which are fastened to the flip flop at position 804. Accordingly, the U-shaped second strap 808 can be fastened to the first strap 806 by wrapping around the first strap 806 at the junction 200. Additionally or alternatively, the first strap 806 and second strap 808 can be joined by gluing, by forming integral with one another, by twisting around one another, by heat treatment, by fastening members, or by any other suitable attaching mechanism or combination thereof.

The second strap 808 can be suitably attached to the sole 812, for example at a position 814 near the front of the sandal 800. In some embodiments, the second strap 808 is coupled to the sole 812 at the position 814 via a post base (e.g., as illustrated and described previously herein). Additionally or alternatively to using a post base, the second strap 808 can be attached joined sole 812 by forming integral with the sole 812, by gluing, by stitching, by fastening members, by heat treatment, or by any other suitable attaching mechanism or combination thereof. The second strap 808 can be configured to fit between the toes of the wearer. Accordingly, the second strap 808 can effectively serve the function of a thong.

However, in some embodiments the second strap 808 is replaced by a thong or equivalent thereof. As other alternatives, the second strap can merely be a portion of the first strap 806. For example, the second strap 808 can be replaced by a portion of the first strap 806 that has been pinched together to form the stem/base of a Y shape. Thus, in such embodiments, the first strap 806 comprises three portions: two end portions coupled to the back, middle, or front of the sandal 800, and a central joined portion coupled to the front of the sandal 800 for fitting between the toes of a wearer. In general, one of skill in the art will appreciate that the sandal 800 is not limited to any particular number of straps or portions thereof. Rather, many alternatives and modifications are possible and can be selected depending on the particular style, design, etc.

Figure 8B:
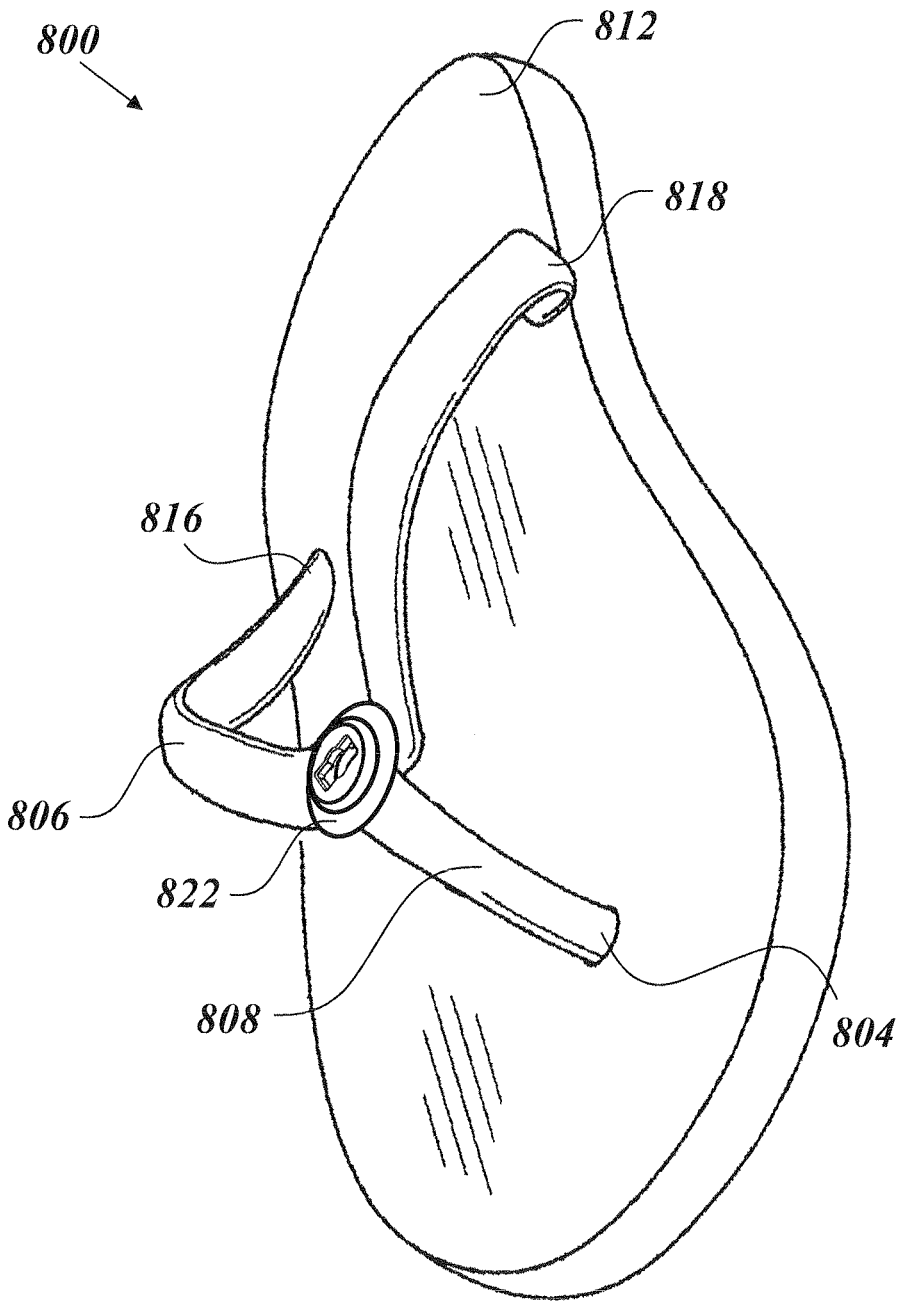

As depicted in FIG. 8B, the sandal 800 further can include a receiver fastening member 822 coupled one or more of the straps (such as the first strap 806 and the second strap 808). The receiver fastening member 822 can be fixedly coupled one or more of the straps near the junction 820 of the strap(s). However, the receiver fastening 822 is not limited to any particular position at which it is coupled to the sandal 800. Other positions for the receiver fastening member 822 are possible, as well as the inclusion of multiple receiver fastening members 822 placed at one or more different sites on the sandal 800.

FIGS. 9A through 9D depict the receiver fastening member 822 in greater detail from a perspective view, a bottom view, a top view, and a cross sectional view, respectively. In particular, the fastening member 822 includes a housing 824 that at least partially encloses an inner cavity 826. In the example of FIGS. 9A through 9D, the housing 824 is substantially cylindrical shaped. However, many other suitable shapes are possible. The housing 824 can include an upper portion 828 situated at or near a top of the housing 824. The upper portion 828 includes an outer face (i.e., facing away from the inner cavity) and an inner face (i.e., facing in toward the inner cavity). In the embodiments of FIGS. 9A through 9D, the upper portion 828 is substantially flat. Alternatively, the upper portion 828 can be undulating or otherwise non-flat. An opening 830 can be disposed in and through the housing 824 in such a way that the opening 830 leads to the inner cavity 826. In the example, the opening 830 can be disposed in and through the upper portion 828 as depicted in FIG. 9A.

The opening 830 of FIGS. 9A through 9D has a perimeter that is generally rectangular shape and which further includes a slight protuberance or bulge near the center of each of its two longer sides. The exemplary shape of the opening 830 as depicted in FIGS. 9A through 9D is adapted to receive a corresponding protruding member of an ornament, depicted at least in FIG. 10 and described in greater detail herein. In general, however, the opening 830 can assume any shape sufficient to receive one or more protruding members (or some portion thereof) of an ornament to be fastened to the sandal 800. One of skill in the art will appreciate that there are many such suitable shapes for the opening 830, and thus the example shapes, positions, sizes, and the like of the opening 830 are illustrative and in no way limiting.

The receiver fastening member 822 can include one or more projections 832 that are coupled to or joined with the housing 824, and which extend into the inner cavity 826. The projections 832 can be joined with the housing 824 on an inner face thereof, such as the inner face of the upper portion 828 through which the opening 830 is disposed. Alternatively, the projections 832 can be joined with the housing 824 in other positions, such as on one or more wall portions, on a base portion, or on another portion or some combination thereof The projections 832 can be shaped as a ramp or a slope extending into the inner cavity 826. In some embodiments, the projections 832 are configured with a shape of a double-sided ramp, e.g., a shape generally resembling that of a speed bump, a "V," or a "U" such that it possesses both an upward sloping ramp and a downward sloping ramp. In other embodiments, the projections 832 are configured with a shape generally resembling that of a one-way ramp, e.g., a one-directional slope followed by a vertical wall.

The receiver fastening member 822 additionally can include one or more stopping members 834. The stopping members 834 can be shaped as walls or can form other shapes suitable for limiting the operational range of rotational motion by a protruding member on an ornament that has been inserted into the inner cavity 830. For example, in the embodiments depicted in FIGS. 9A through the 9D, one or more stopping members 832 are included each of which generally forms an L shaped wall. In particular, two L-shaped stopping members are included and positioned caddy-corner from one another in such a way that prevents a protruding member on an ornament inserted into the inner cavity 830 from rotating in a clockwise direction (assuming the bottom view perspective of FIG. 9B). Additionally or alternatively, the stopping members 832 can form solid shapes, such as triangular blocks, rectangular blocks, and other solid shapes.

As described previously, the example depicted in FIGS. 9A through 9D includes two projections 832 and two such L-shaped stopping members 834. While two projections 832 are provided for improving the stability of the ornament when in a fastened position, alternative embodiments include only one such projection 832. In the illustrated example, the projections 832 are shaped generally as ramps (e.g., one-way ramps, double sided ramps, and other ramps). The surface of the ramp-shaped projections 832 includes one or more downward sloping portions extending into the inner cavity 830. The one or more downward sloping portions lead to one or more upward sloping portions which slope in an opposite direction as the downward sloping portions and thus lead back to the inner surface of the housing 824. Alternatively, as described previously herein, the surface of the ramp-shaped projections 832 can include one or more first sloped portions extending into the inner cavity 830 and leading to an edge that is substantially perpendicular to the surface of the housing 824 from which it extends, e.g., in such a manner that the projection comprises a first portion comprising a ramp and a second portion comprising a wall.

The receiver fastening member 822 additionally can include a base portion 836, e.g., for affixing the receiver fastening member 822 to the sandal 800. For example, the base portion 836 can be a tapered or un-tapered flange extending transversally out from the base of the housing 824. In one embodiment, the base portion 836 comprises a flange that is tapered at an outer perimeter thereof. In general, the base portion 836 can be formed integral with the housing or fixedly attached thereto. The base portion 836 can allow the receiver fastening member 822 to be more stably anchored or coupled to the sandal 800, for example in an operationally permanent manner. What is meant by an "operationally permanent manner" is that the fastening member 822 is permanently fixed to the sandal 800 so long as the sandal 800 and the fastening member 822 are operational for their intended purposes, e.g., as an article for use in ambulatory motion.

Figure 10:
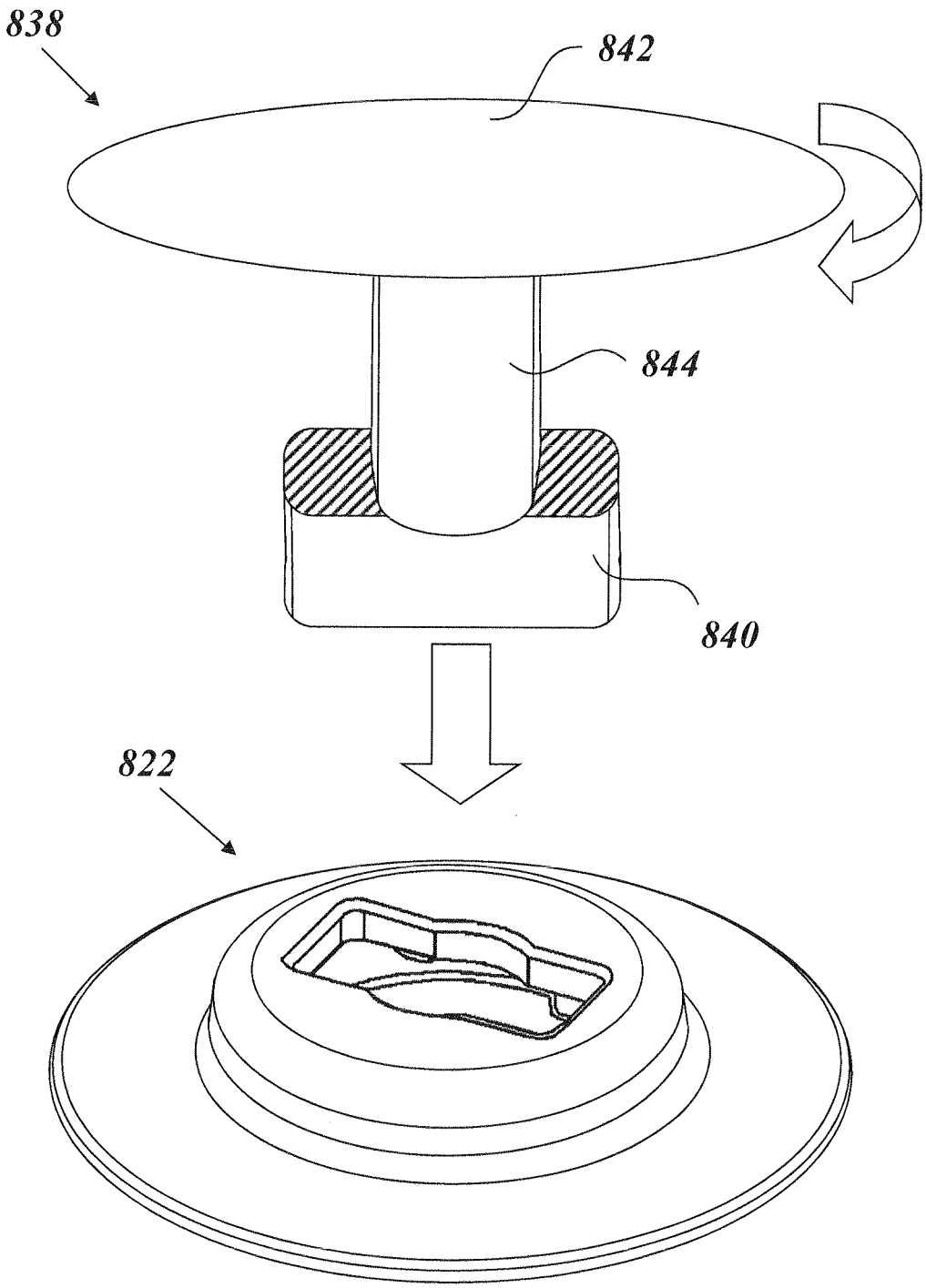
FIG. 10 illustrates an example interchangeable ornament for being releasably fastened to the receiver fastening member.

The projections 832 can have a flexibility sufficient to slightly deform (e.g., compress or bend) in response to a force applied by a protruding member of an attachable ornament. Furthermore, the projections 832 can have a height sufficient to allow the protruding member to pass thereover when the projections 832 are in the deformed. For example, FIG. 10 depicts an example ornament 838 for being received by the receiver fastening member 822. The ornament 838 includes a protruding member 840 and a decorative surface 842. The protruding member 840 is supported by at least one stem 844, which is located substantially along an axis of rotation in the embodiment depicted in FIG. 10. In the example embodiment of FIG. 10, one or more of the corners or edges of the protruding member 840 can be rounded in order to prevent the protruding member 840 from damaging the receiver fastening member 822 when moving into and out of a fastened position.

Figure 11A:
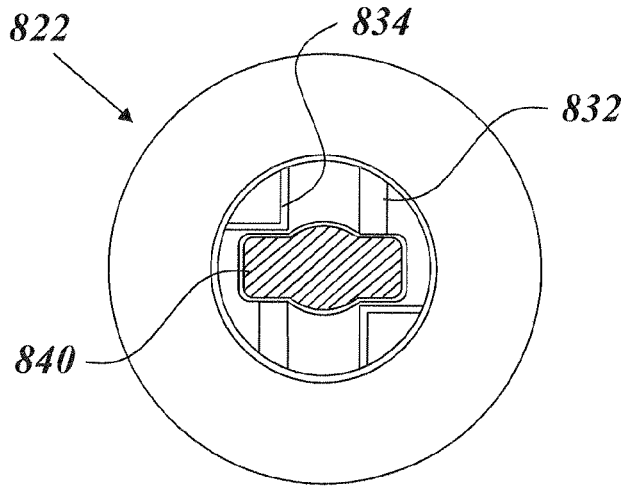
FIGS. 11A, 11B, and 11C illustrate three subsequent stages in the illustrative operation of the receiver fastening member of FIGS. 9A through 9D to receive and fasten a protruding member on the ornament of FIG. 10.
Figure 11B:
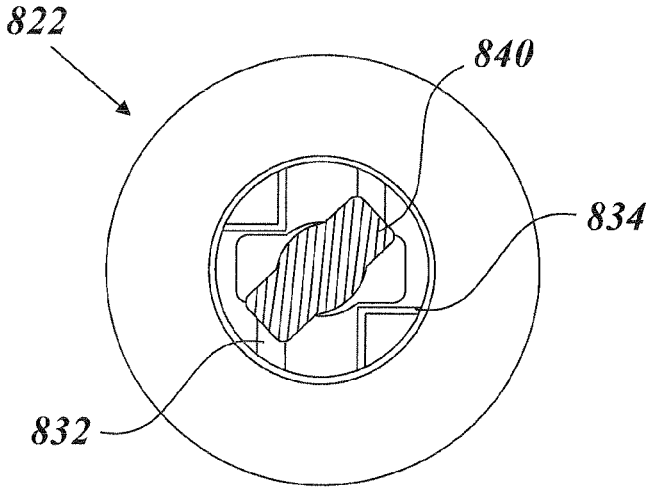
Figure 11C:
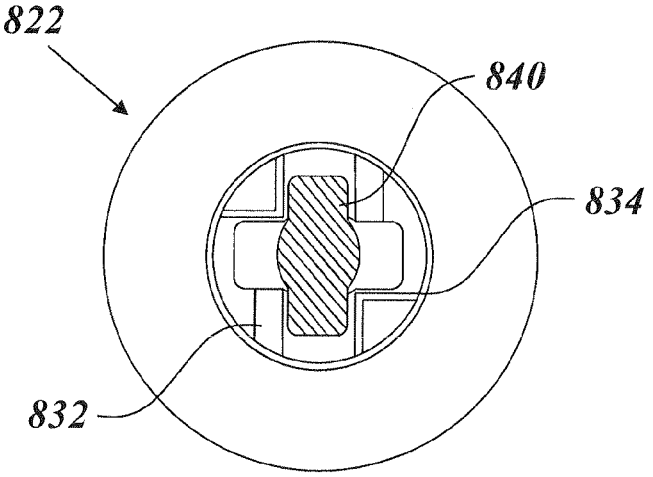

FIGS. 11A through C depict several stages of exemplary operation of the receiver fastening member 822 releasably receiving a decorative ornament 838, as shown from a bottom view of the receiver fastening member 822. The ornament 838 is lowered toward the receiver fastening member 822 until the protruding member 840 fits into the opening 830, as depicted in FIG. 11A. Once in place, the blocking members 834 prevent the protruding member 840 from rotating in a clockwise direction (assuming the perspective of FIG. 11A from below the receiving fastening member 822). Rather, the ornament 838 is moved into a fastened position by rotating the ornament 838 in a counterclockwise direction, causing the protruding member 840 to apply a force against the flexible projections 832 which deforms the flexible projections 832. Alternatively, the projections 832 and the protruding member 840 can be configured to initially permit rotation only in a clockwise direction, or to initially permit rotation in both a clockwise and a counter clockwise direction. As depicted in FIG. 11B, the continued application of the rotating force on the ornament 838 causes the protruding member 840 to continue to pass over, alongside, etc. the deformed flexible projections 832.

As shown in the embodiment of FIG. 11C, the protruding member 840 completes its pass of the flexible projections 832, e.g., allowing it to move into a fastened configuration.

For example, the protruding member 840 can be sized to fit snuggly in a fastened position between the flexible projections 832 and the blocking members 834. In illustrative embodiments, the force of the protruding member 840 upon the flexible projections 832 is no longer applied once the protruding member 840 is in a fastened position, causing the flexible projections 832 to reassume a non-deformed state. Once in a fastened configuration, the L-shaped blocking members 834 halt any further rotational motion of the protruding member 840 in a counterclockwise direction, thus preventing further angular displacement. Limiting the amount of permitted angular displacement of the protruding member 840 within the inner cavity 826 obviates the problem of over-turning by a user.

In embodiments wherein the projections 832 include a first sloped portion or surface and a second vertical portion or surface (e.g., effectively forming a wall), the protruding member 840 rapidly moves into the fastened position once its clears the projections 832 (e.g., as it slides down the wall). This creates the benefit of providing the user with a noticeable tactile indication that the ornament 838 is in place and requires no further turning from the user. For instance, such a wall can create a feeling that the ornament 838 has "snapped" into place once it enters the fastened position. This tactile feature can improve overall convenience of the sandal 800 and ornaments 838 by making their operation more user-friendly. The tactile feature further can be provided in embodiments utilizing projections 832 shaped as double-sided ramps. As one example, this tactile indication can be enabled by: a) forming the projections 832 to comprise a first sloped portion leading into a second sloped portion leading into the fastened position, and by b) further providing that the second sloped portion leading into the fastened position is sufficiently steep to create a tactile indication during the passage of the protruding member 840 into the fastened position.

Removal of the ornament 838 is accomplished by turning the ornament 838 in the opposite direction (e.g., clockwise in the example provided above). This rotation by the user similarly creates a force against the flexible projections 832 that again deforms the flexible projections 832. The protruding member 840 then passes fully over the flexible projections 832 into an unfastened position, from which the protruding member 840 can be lifted out of the receiver fastening member 822, thereby removing the ornament 822 from the receiver fastening member 822. In embodiments where the projections 832 include a portion comprising a wall, it may be necessary for the user to initially push the ornament 838 downward prior to turning the ornament 838 in order to clear the portion of the projections 832 comprising the wall.

In such embodiments wherein the receiver fastening member 822 includes one or more blocking members 834 (e.g., substantially L-shaped walls), users fastening an ornament to the sandal 800 are enabled to turn the ornament 838 in only a single direction. This can provide the benefit of preventing ornaments from being inadvertently rotated into an improper orientation by a user. For example, if a particular ornament contains text intended to face in a particular direction (e.g., in a direction enabling the text to be read by a colleague that is facing the wearer), then the blocking members 834 can ensure that the ornament is properly oriented when configured in a fastened position. Thus, the blocking members 834 can be included to improve convenience and handling for wearers.

The blocking members 834, the opening 830, and the protruding member 840 of the ornament 838 can be configured virtually in any arrangement such that the fastened position of the ornament 838 in the receiver fastening member 822 and the unfastened position of the ornament 838 in the receiver fastening member 822 are separated by any desired predetermined angular displacement. In the example embodiment of FIGS. 9A through 9D, the fastened position and the unfastened position are separated by an angular displacement of about 90°. Accordingly, the user turns the ornament 838 about 90° in order to "lock" and "unlock" the protruding member 840 into and out of a fastened position.

In other embodiments, the blocking members 834 are not included or may not be necessary in order to prevent over-turning. For example, the ornament 838 can include a second stem (not shown) that is coupled to the protruding member 840 at a position that is displaced by a distance away from the axis around which the protruding member 840 is turned. The opening 830 can include a portion shaped to receive the second stem. The portion of the opening 830 shaped to receive the second stem further can be shaped as an arc which occupies a predetermined amount of angular displacement (e.g., 90°). Accordingly, as the ornament 838 is turned in order to pass the protruding member 840 over the projections 832, the second stem passes through the arc-shaped portion of the opening 830 until the second stem reaches the end of the arc. Thus, the arc-shaped portion of the opening limits the ornament 838 to a predetermined range of rotation (e.g., 45°, 90°, 135°, 180°, 225°, and any other quantity of angular displacement).

In general, the protruding member 840 and receiver fastening member 822 may be sized and shaped in such a way that enables the protruding member 840 to fit snuggly in the inner cavity 830 and remain securely in a fastened position until a subsequent rotational force is applied by the user. This can help avoid the problem of the ornament 838 becoming inadvertently unfastened during use. For example, in some embodiments, the protruding member 840 is shaped to experience a friction fit when positioned into in the space between the stopping members 834 and projections 832. Alternatively, protruding members can have a shape with one or more protuberances or other structural features that create a suitable friction fit for maintaining the protruding members 840 securely in the fastened position.

Alternatively or additionally to specifically sizing and shaping the protruding member 840 in order to create a friction fit or snug fit, the stem 844 and housing 824 similarly can be sized and shaped to create a friction fit or snug fit. For example, the length of the stem 844 can be sufficient to allow the decorative component 842 (or alternatively another piece of the ornament, such as a depth guard) to apply a small force against the top of the housing 824 when the protruding member 840 is in a fastened position. Accordingly, a friction fit or snug fit can be created between the decorative component 842, and the top portion of the housing 824, and the protruding member 840.

In general, the receiver fastening member 822 can be fastened to the sandal 800 in any number of ways. For instance, the receiver fastening member 822 can be embedded at least partially, substantially, or entirely in the sandal 800, can be stitched to the sandal 800, can be sewn into the sandal 800, can be glued to the sandal 800, can be formed integral with the sandal 800, can be coupled to the sandal 800 via heat treatment, can be over-molded into the sandal 800, and can be coupled to the sandal in any other suitable way. For example, in an illustrative embodiment, the one or more straps of the sandal 800 are formed of leather and the receiver fastening member 822 is embedded into one or more of the one or more straps by sewing the base portion 836 (e.g., the tapered flange) into the one or more straps. Accordingly, the base portion 836 and/or the straps can include one or more threading holes to facilitate the sewing. Furthermore, the receiver fastening member can include a cover disposed thereon to improve its aesthetic appeal. For example, the cover can match the material, color, etc. of an ornament, the straps, or another portion of the sandal 800.

The receiver fastening member 822 can be formed of any suitable material, including, as illustrative examples, nylon, nylon/glass composite, nylon/talc composite, polypropylene, and any other suitable material. The ornament 838 can be any suitable material, such as metal, plastic, leather, enamel, stone, and any other suitable material. In one embodiment, the ornament 838 (e.g., decorative component 842, protruding member 840, and stem 844) can be manufactured from a metal cast as a single piece. In the alternative, one or more of the decorative component 842, the protruding member 840, and the stem 844 can be constructed from a different material and subsequently fastened, adhered, or otherwise attached together.

It should be noted that many other embodiments and alternatives are possible. While the exemplary embodiment of FIGS. 9A through 9D are configured for rotational motion, the receiver fastening member 822 can be configured such that the ornament 838 moves into a fastened position through other types of motions. As just one example, the protruding member 840, the opening 830, and the projections 832 alternatively can be configured in such a way that the protruding member 840 is fastened as a result of linear movement and displacement.

Figure 13:
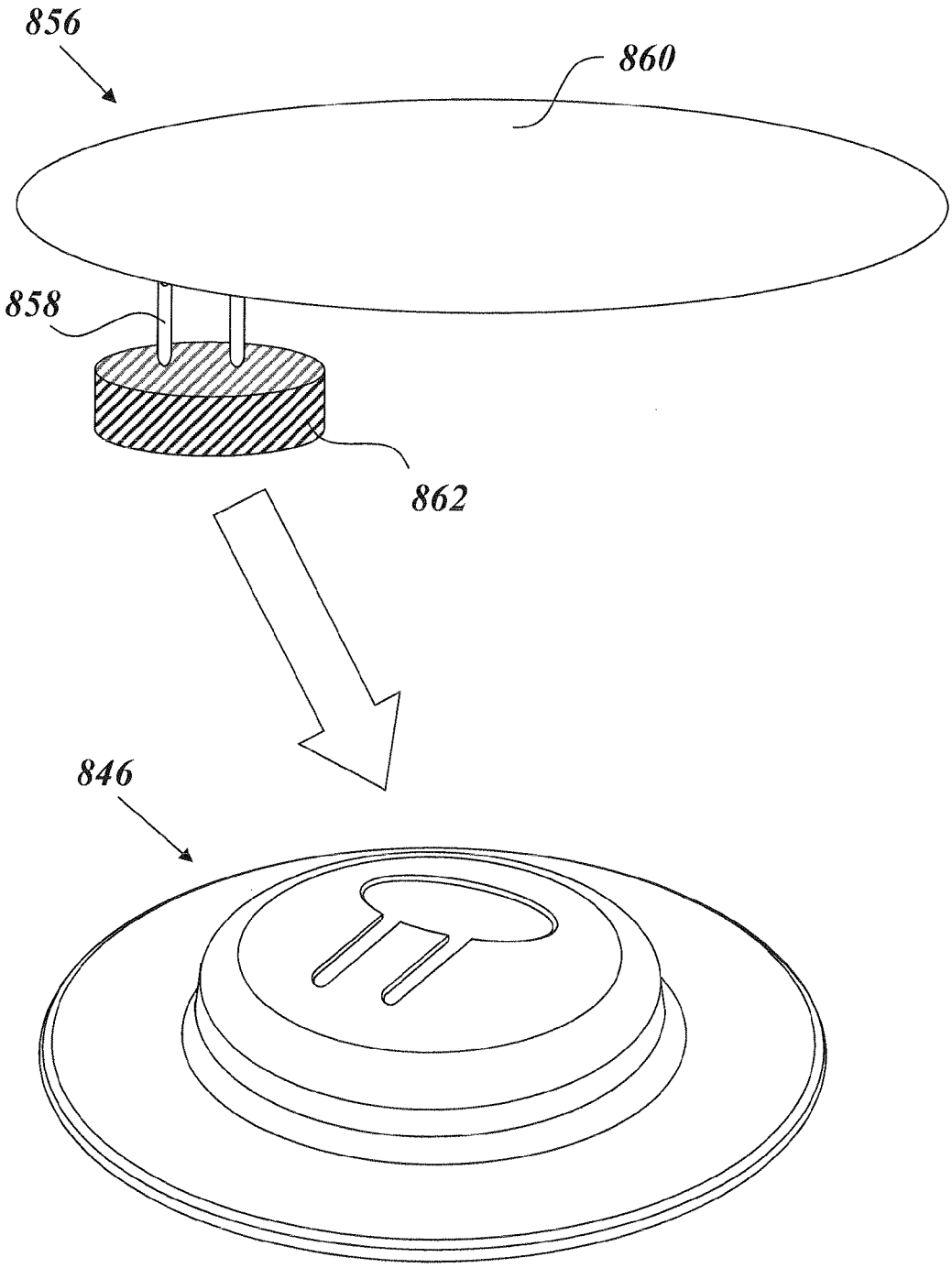
FIG. 13 depicts an alternative ornament for being received by the receiver fastening member of FIGS. 12A through 12D.

For example, FIGS. 12A through 12D depict one possible alternative embodiment of a receiver fastening member 846 comprising a housing 864 at least partially enclosing a cavity 866. An opening 848 disposed in and through the housing 864 includes a first portion 850 configured to receive a protruding member having an oval shaped perimeter. FIG. 13 depicts one example of an ornament 856 having such a protruding member 862. In addition, the ornament 856 also includes one or more stems 858 and a decorative component 860.

With further reference to FIGS. 12A through 12D, in addition to the first portion 850, the opening 848 also includes one or more second portions 852 that act as channels for allowing the stems 858 supporting the protruding member 862 to pass therethrough. The receiver fastening member 846 includes one or more flexible projections 854 that can be shaped, for example, as double sided ramps, and which can have a flexibility sufficient to deform (e.g., compress) under an applied pressure by the protruding member. Other shapes are possible, as described in detail previously herein.

Figure 14A:
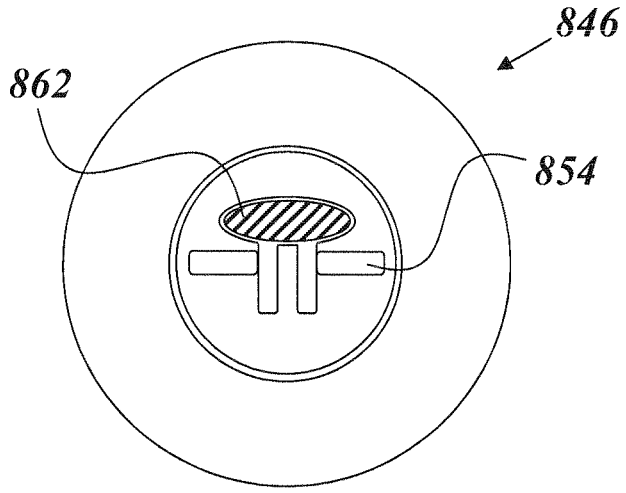
FIGS. 14A, 14B, and 14C illustrate three subsequent stages in the illustrative operation of the receiver fastening member of FIGS. 12A through 12D to receive and fasten a protruding member on the ornament of FIG. 13.
Figure 14B:
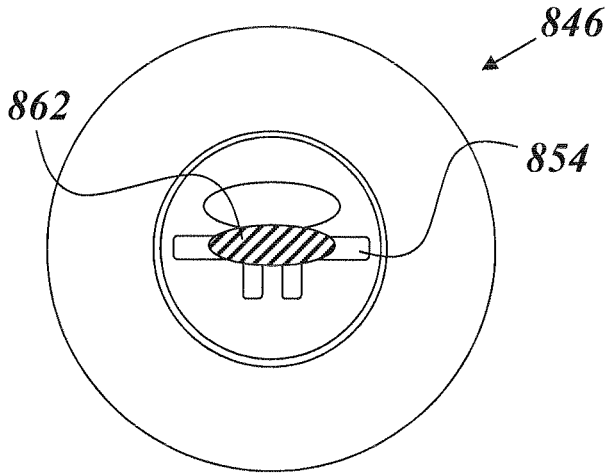
Figure 14C:
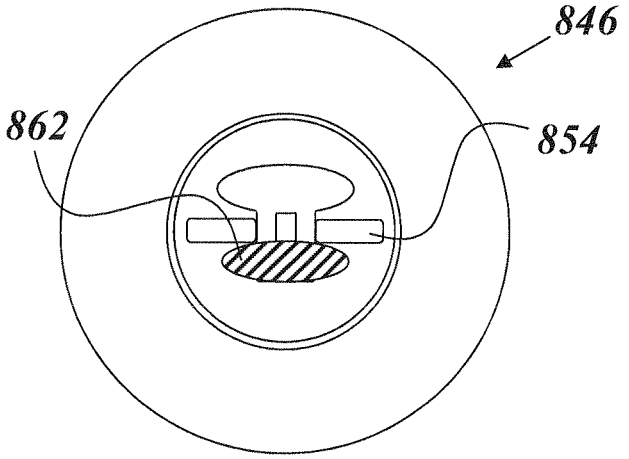

Operation of the receiver fastening member 846 can proceed similarly to operation as described with reference to FIGS. 11A through 11C. For example, FIGS. 14A through 14C depict several stages of exemplary operation of the receiver fastening member 846 releasably receiving the decorative ornament 856, as shown from a bottom view of the receiver fastening member 846. The ornament 856 is lowered toward the receiver fastening member 846 until the protruding member 862 fits into the first portion 850 of the opening 848, as depicted in FIG. 11A. Once in place, the ornament 856 is moved forward (e.g., transversally) such that the stems 858 pass through the channel-shaped portions 852, causing the protruding member 862 to apply a force against the flexible projections 854, which deforms the flexible projections 854. As depicted in FIG. 11B, the continued application of the transverse force on the ornament 860 causes the protruding member 862 to continue to pass over the deformed flexible projections 854.

As shown in the embodiment of FIG. 11C, the protruding member 862 completes its pass of the flexible projections 854, e.g., allowing it to move into a fastened position and optionally providing the user with a tactile indication that no further forward motion is necessary. The protruding member 862 can be sized to fit snuggly in a fastened position between the flexible projections 854 and a wall of the housing. Alternatively, one or more blocking members can be included. Once the protruding member 862 is in a fastened position, the force of the protruding member 862 upon the flexible projections 854 is no longer applied, which causes the flexible projections 854 to reassume a non-deformed state. Removal is accomplished by moving the ornament 856 in the opposite direction, over the flexible projections 854 and subsequently pulling the ornament 856 out of the first portion 850 of the opening 448.

Yet other embodiments not described herein are possible, as will be appreciated by one of skill in the art upon reading the present specification. In general, any suitable size, arrangement, and configuration of the elements described herein is possible, so long as at least one projection is situated at a position disposed in the path of motion that the protruding members of the ornament follow in order to move from an unfastened position into a fastened position. However, the path of motion of the protruding members from the unfastened position to the fastened position can be selected based on the desired shape and size of the ornament to attached to the sandal, the particular position on the sandal of the receiver fastening member, the number of stems to be included in the ornament, and the like.

It should be noted that the sandals and fastening members provided herein do not require that the projections possess a flexibility sufficient to deform under the force of the protruding member(s) of the ornament. For example, in some alternative embodiments, the requisite flexibility or "give" that enables the protruding members to move past the projections can be derived from the flexibility of other components. As non-limiting examples, other such components can include any one or more of the following: the housing of the inner cavity, the portion of the sandal to which the receiver fastening member is attached, or the protruding members on the ornament. For instance, the base portion of the housing can extend across the bottom area of the inner cavity and can possess a flexibility sufficient to deform (e.g., compress or bend downward) in response to a downward force applied by the bottom surface of the protruding members. Accordingly, in such an embodiment, the temporary deformation or compression of the base portion of the housing allows the protruding members of the ornament to clear the projections. In a similar manner, other components can be provided with a sufficient flexibility to enable passage of the protruding members along a predetermined path leading from an unfastened position to a fastened position within the cavity.

Furthermore, although the illustrative embodiments described in detail herein provide that one or more components of the sandal (such as the projections, the housing, the straps, etc.) possess a flexibility sufficient to enable the one or more protruding members of the ornament to pass over, pass alongside, etc. the one or more projections disposed in the path of motion of the protruding members, such flexibility is not required. For instance, in alternative embodiments, the protruding members can be shaped and sized to easily pass over the projections in an un-deformed state. In such embodiments, upon clearing the un-deformed projections, the protruding members can become positioned in a differently sized area within the inner cavity having one or more surfaces that creates a friction fit for securely maintaining the protruding members in a fastened position.

Accordingly, if the wearer wants to replace an ornament attached to a sandal with a different ornament, the fasteners described herein may simply be unfastened and a replacement ornament may then be fastened to the sandal.

The part of the fastener that is embedded into the sole or the strap post of the shoe or flip-flop may be embedded in a variety of ways including through molding, gluing, sewing, and any other means available to securely attach the fastener to the thong or sole of the shoe or flip-flip.

The flip-flop sandals described herein provide an apparatus for decorating the sandal with a replaceable and interchangeable ornament on the part of the thong that is between the big toe and the second toe.

Figure 7:
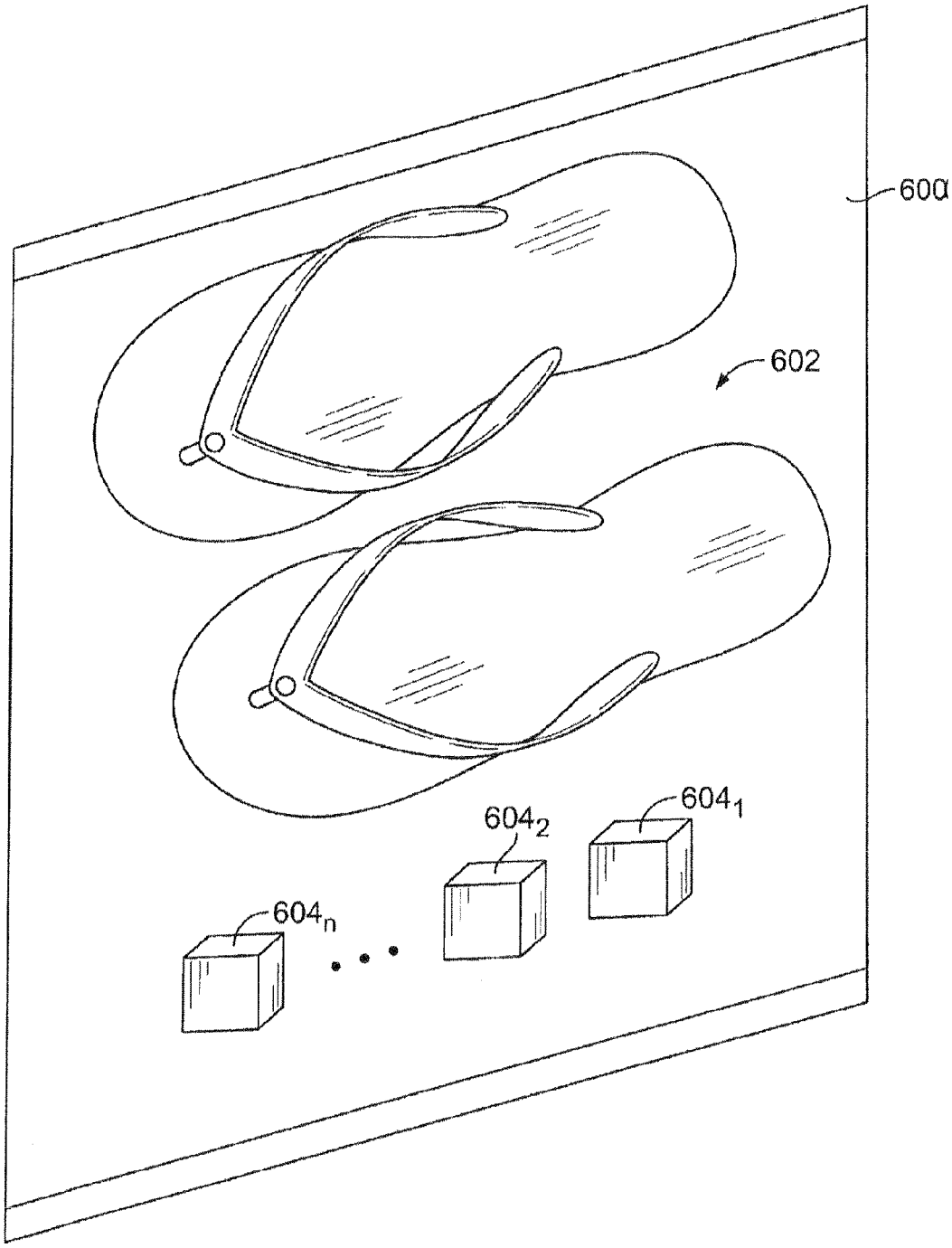
FIG. 7 illustrates a package that is ready for marketing and that contains a plurality of replaceable and interchangeable ornaments.

As shown in FIG. 7, the sandals can be sold as a package 600 containing a pair of sandals 602 and sets $\mathbf{604}_1$, $\mathbf{604}_2, \ldots, \mathbf{604}_n$ of replaceable and interchangeable ornaments (e.g., each set contains two ornaments, one for each sandal) so that the wearer can change out ornaments on the sandals from time to time.

Alternatively, the sandals can be sold in a package with only a single set of replaceable and interchangeable ornaments (i.e., only one ornament per sandal). In this case, if the wearer wishes a different look to the sandals, the wearer can separately purchase replacement ornaments to replace to original ornaments that came with the sandals.

The sandals can be sold with the replaceable and interchangeable ornaments pre-fastened to the sandal. However, because the ornaments are replaceable and interchangeable ornaments, the replaceable and interchangeable ornaments need not be pre-fastened to the sandal.

Specific fasteners have been described herein. However, other fasteners could be used as well as long as at least a portion or substantial portion of the fastener associated with the thong is embedded into the thong.

Also, any materials, such as plastic, can be used for the fasteners. Preferably, a material should be chosen so that the fastener securely yet removably fastens the ornament to the flip-flop. Also preferably, the material should be chosen so that the fastener is non-corrosive and can withstand water, sand, and other waste though which the wearer of the flip-flop may walk.

The flip-flops described herein may be molded using any suitable molding technique, such as over-mold. The molding technique, with respect to a rubber flip-flop, or a rubber-like flip-flop, may be, for example, an over-molding technique. The receiver fastening member and it's mating fastening member attached to the ornament may be composed of a compound with a higher durometer than the shoe. This higher durometer material could be plastic, or a thermoplastic rubber compound, or any other material. The manufacturing technique, with respect to a leather, or leather-like flip-flop, will be different from the molding process used to manufacture the rubber-like flip-flop. However, the receiver fastening member that is embedded into the leather, or leather-like flip-flop, will be similar to, or identical to, the piece that is embedded into the rubber, or rubber-like flip-flop, in order to accommodate the same mating fastening member as the rubber, or rubber-like shoe. The manufacturing technique with respect to the manner in which the receiver piece gets embedded into any other type of shoe or other apparel may vary from shoe to shoe or from apparel to apparel in order to ensure that the portion of the fastening member that is embedded into the shoe or other apparel is done so in the most secure, sturdy, and permanent manner.

Alternatively, the flip-flops can be other materials such as leather. The manufacturing technique, with respect to a leather, or a leather-like flip-flop, may be different from the molding process used to manufacture a rubber-like flip-flop. However, a fastening portion embedded into a leather thong, or a leather-like thong, can be similar to, or identical to, or different from, a fastening portion embedded into a rubber thong, or a rubber-like thong. Alternatively, receiver fastening members can be stitched to, sewn to, adhered to, or otherwise attached to the leather-like thong, straps, etc.

Furthermore, as described herein, the receiver fastening members, including those of FIGS. 9A through 14C, may be included in shoes, other types of sandals, articles of clothing or other apparel, pocket books, and any other suitable article. For example, such articles can include one or more of the receiver fastening members, which can be embedded or otherwise coupled to a portion of the article. The portion of to article to which the receiver fastening member is attached can be leather. Furthermore, in illustrative embodiments, the receiver fastening member can be embedded or otherwise coupled to the portion of the article in an operationally permanent manner.

Numerous modifications and alternative embodiments will be apparent to those of skill in the art in view of the foregoing description. Accordingly, this description is to be construed as illustrative only and is for the purpose of teaching those skilled in the art the best mode for carrying out the disclosed embodiments. Details of the structure may vary substantially without departing from the spirit disclosed herein, and exclusive use of all modifications that come within the scope of the appended claims is reserved. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall therebetween.

What is claimed is:

1. A flip-flop sandal comprising:

a sole;

at least one strap coupled to the sole and positioned to maintain the sandal on the foot of a wearer;

a fastening member coupled to the strap for releasably receiving an ornament that comprises a protruding member;

wherein the fastening member comprises:

an inner cavity and a housing at least partially enclosing the inner cavity;

an opening disposed in and through an upper surface of the housing in such a way that the opening leads to the inner cavity, the opening being shaped to receive the protruding member of the ornament;

a flexible projection extending into the inner cavity and being joined with an inner face of the upper surface of the housing on a first side of the opening, the flexible projection having a flexibility sufficient to deform in response to a force caused by rotation of the protruding member of the ornament within the inner cavity;

a first stopping member extending into the inner cavity and being joined with the inner face of the upper surface of the housing on the first second side of the opening; and a second stopping member extending into the inner cavity and being joined with the inner face of the upper surface of the housing on a second side of the opening that is opposite the first side of the opening;

wherein the flexible projection and the first stopping member form a space for securely and releasably maintaining the protruding member of the ornament in a fastened position.

2. A sandal, comprising:

a sole;

one or more straps positioned to maintain the sandal on the foot of the wearer, each of the one or more straps having at least one end that is operationally connected to the sole; and a fastening member for releasably receiving an ornament comprising one or more protruding members, the fastening member being coupled to at least one of the one or more straps;

wherein the fastening member comprises:

an inner cavity and a housing at least partially enclosing the inner cavity;

an opening disposed in and through an upper portion of the housing in such a way that the opening leads to the inner cavity, the opening having one or more portions that are shaped to receive the one or more protruding members of the ornament; and one or more projections joined with the housing and extending into the inner cavity, each of the one or more projection being situated at a position along a path of motion of at least one of the one or more protruding member from an unfastened position to a fastened position; and wherein the one or more projections have a flexibility sufficient to deform in response to a force by the protruding member of the ornament.

3. The sandal of claim 2, wherein the one or more projections are joined with the housing on an inner face of the upper portion of the housing.

4. The sandal of claim 2, wherein the fastening member further comprises one or more stopping members extending into the cavity and joined with the housing.

5. The sandal of claim 2, wherein the fastening member is coupled to the at least one of the one or more straps in an operationally permanent manner.

6. The sandal of claim 2, wherein the housing comprises a base portion.

7. The sandal of claim 6, wherein the base portion comprises a tapered flange.

8. The sandal of claim 2, wherein the fastening member further comprises one or more spaces for releasably securing the one or more protruding members in a fastened position.

9. The sandal of claim 2, wherein the path of motion of the one or more protruding members comprises about a 90° arc.

10. The sandal of claim 2, wherein at least one of the one or more projections comprises a first sloped portion and a second sloped portion that slopes in an opposite direction longitudinally from the first sloped portion.

11. The sandal of claim 10, wherein the first sloped portion has a first slope and the second sloped portion has a second slope that is the same or different from the magnitude of the first slope.

12. The sandal of claim 2, wherein at least one of the one or more projections comprises a first sloped portion and a second portion that is perpendicular to an inner face of the upper portion of the housing.

13. The sandal of claim 2, wherein at least one of the one or more straps comprises leather.

14. The sandal of claim 2, wherein the fastening member comprises nylon, nylon/glass composite, nylon/talc composite, or polypropylene.

15. A kit, comprising at least one of an ornament and at least one of a sandal, wherein the ornament comprises one or more protruding members and further wherein the sandal comprises:

a sole;

one or more straps positioned to maintain the sandal on the foot of the wearer, each of the one or more straps having at least one end that is operationally connected to the sole; and a fastening member for releasably receiving the ornament, the fastening member being coupled to at least one of the one or more straps;

wherein the fastening member comprises:

an inner cavity and a housing at least partially enclosing the inner cavity;

an opening disposed in and through an upper portion of the housing in such a way that the opening leads to the inner cavity, the opening having one or more portions that are shaped to receive the one or more protruding members of the ornament; and one or more projections joined with the housing and extending into the inner cavity, each of the one or more projection being situated at a position along a path of motion of one of the one or more protruding member from an unfastened position to a fastened position; and wherein the one or more projections have a flexibility sufficient to deform in response to a force by the protruding member of the ornament.

* * * * *